US012446737B2

(12) United States Patent
Möller et al.

(10) Patent No.: US 12,446,737 B2
(45) Date of Patent: Oct. 21, 2025

(54) DISPENSER FOR DISPENSING SHEET PRODUCTS

(71) Applicant: Essity Hygiene and Health Aktiebolag, Gothenburg (SE)

(72) Inventors: Per Möller, Borlänge (SE); Karl Walheim, Borlänge (SE); Lars Thorén, Borlänge (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 235 days.

(21) Appl. No.: 17/428,418

(22) PCT Filed: Mar. 11, 2019

(86) PCT No.: PCT/EP2019/055970
§ 371 (c)(1),
(2) Date: Aug. 4, 2021

(87) PCT Pub. No.: WO2020/182283
PCT Pub. Date: Sep. 17, 2020

(65) Prior Publication Data

US 2022/0133100 A1 May 5, 2022

(51) Int. Cl.
*A47K 10/42* (2006.01)
*A47B 81/00* (2006.01)
*A47K 10/32* (2006.01)

(52) U.S. Cl.
CPC ..... *A47K 10/424* (2013.01); *A47B 81/00* (2013.01); *A47K 2010/3233* (2013.01); *A47K 2201/02* (2013.01)

(58) Field of Classification Search
CPC ..... A47B 81/00; A47K 10/424; A47K 2010/3233; A47K 2201/02; A47F 1/08
See application file for complete search history.

(56) References Cited

U.S. PATENT DOCUMENTS 372,181 A * 10/1887 Speed ..... B65D 83/0409 221/266
1,371,982 A * 3/1921 Sartin ..... A24F 27/10 206/101

(Continued)

FOREIGN PATENT DOCUMENTS

CN 102231961 A 11/2011
CN 107249413 A 10/2017

(Continued)

OTHER PUBLICATIONS

Office Action (Notification of the Second Office Action) issued on Dec. 30, 2022, by the Chinese Patent Office in corresponding Chinese Patent Application No. 201980092176.5, and an English Translation of the Office Action. (17 pages).

(Continued)

*Primary Examiner* — Gene O Crawford
*Assistant Examiner* — Kelvin L Randall, Jr.
(74) *Attorney, Agent, or Firm* — BUCHANAN INGERSOLL & ROONEY PC

(57) ABSTRACT

A set for mounting a dispensing mechanism for dispensing sheet products within an existing dispenser cabinet that comprises a bottom wall having a dispensing opening, the set comprising the dispensing mechanism, wherein the dispensing mechanism comprises a lower portion, the lower portion comprising a first connection portion, a mounting structure comprising a second connection portion to which the first connection portion of the lower portion is attachable to support the dispensing mechanism, wherein the mounting structure is fastenable to the bottom wall.

31 Claims, 15 Drawing Sheets

(56) References Cited

U.S. PATENT DOCUMENTS 2,932,426 A * 4/1960 Hope ..... A47K 10/44 221/36
3,028,047 A * 4/1962 Tuft ..... A47K 10/424 221/199
3,263,860 A * 8/1966 Haas ..... A47F 1/10 221/281
3,432,217 A 3/1969 Cowan
4,260,896 A * 4/1981 Schmidt ..... G03B 42/021 378/173
4,448,462 A * 5/1984 Smith ..... A47K 10/28 312/34.11
5,054,777 A * 10/1991 Borden ..... A63B 57/353 172/380
5,154,496 A * 10/1992 Campbell ..... A47K 10/38 221/199
5,322,186 A * 6/1994 Frazier ..... A47K 10/424 221/65
5,857,642 A * 1/1999 Zinnbauer ..... A47K 10/3818 242/593
5,950,863 A 9/1999 Schutz et al.
6,003,723 A 12/1999 Morand
6,354,462 B1 * 3/2002 Conran ..... A47K 10/185 221/48
7,025,301 B1 * 4/2006 Notarnicola ..... A47K 10/3818 242/593
7,997,443 B2 * 8/2011 Titas ..... A47K 10/3818 242/615.3
8,162,252 B2 * 4/2012 Cittadino ..... A47K 10/36 242/564.3
8,215,520 B2 * 7/2012 Miller ..... A47F 3/002 221/184
8,870,024 B2 * 10/2014 Mendes ..... A47F 1/03 222/413
9,010,602 B2 * 4/2015 Budz ..... A47K 10/3637 242/564.2
9,687,125 B2 * 6/2017 Marietta-Tondin ..... A47K 10/3818
11,363,919 B2 * 6/2022 Allard ..... A47K 10/38
2005/0161464 A1 * 7/2005 Fiola ..... A47G 21/16 221/33
2009/0120952 A1 * 5/2009 Cattacin ..... A47K 10/38 221/154
2009/0184130 A1 * 7/2009 Miller ..... A47F 1/126 221/282
2011/0011879 A1 * 1/2011 Johnson ..... A47K 10/422 221/45
2011/0036855 A1 * 2/2011 Petocchi ..... A47K 10/3612 221/9
2011/0266299 A1 * 11/2011 Fodor ..... A47K 10/24 221/102
2012/0036975 A1 * 2/2012 Jokitalo ..... A47K 10/36 83/436.5
2013/0341346 A1 * 12/2013 Kling ..... A47K 10/24 221/283
2017/0135535 A1 * 5/2017 Larsson ..... A47K 10/422
2018/0035850 A1 2/2018 Larsson et al.

FOREIGN PATENT DOCUMENTS

KR 101535040 B1 7/2015
WO 2013007302 A2 1/2013
WO 2014065733 A1 5/2014
WO 2014200394 A1 12/2014

OTHER PUBLICATIONS

International Search Report (PCT/ISA/210) and Written Opinion (PCT/ISA/237) mailed on Mar. 20, 2020, by the European Patent Office as the International Searching Authority for International Application No. PCT/EP2019/055970.
Response to the International Search Report and Written Opinion issued in corresponding International Application No. PCT/EP2019/055970 dated Dec. 16, 2020.
Response to the Written Opinion of the International Preliminary Examining Authority in corresponding International Application No. PCT/EP2019/055970 dated Apr. 12, 2021.
Written Opinion of the International Preliminary Examining Authority issued in corresponding Patent Application No. PCT/EP2019/055970 dated Mar. 11, 2019.
Office Action (Notification of the First Office Action) issued on May 7, 2022, by the China National Intellectual Property Administration (CNIPA) of the People's Republic of China in corresponding Chinese Patent Application No. 201980092176.5, and an English Translation of the Office Action. (23 pages).
Office Action issued in Canadian Patent Application No. 3,131,042, dated May 18, 2023 (4 pages).
Office Action issued on Jun. 3, 2024, by the Canadian Patent Office in corresponding Canadian Patent Application No. 3,131,042. (4 pages).

* cited by examiner

DISPENSER FOR DISPENSING SHEET PRODUCTS

TECHNICAL FIELD

The present disclosure relates to a dispenser for dispensing sheet products, particularly sanitary paper sheet products such as hand towels, paper napkins, facials, toilet paper, or other wiping products in sheet form. More particular, the disclosure relates to a dispensing mechanism to be mounted in an existing cabinet, preferably an existing recessed cabinet, for retrofitting. Furthermore, the present disclosure relates to a method for mounting a dispensing mechanism.

BACKGROUND

Sheet products are generally stacked or rolled up and accommodated in a cabinet of a dispenser. Dispensing of sheet products through a dispensing opening formed in the dispenser cabinet is enabled by a dispensing mechanism allowing a user to grasp a leading sheet product, for example a protruding part of a leading sheet product protruding from the dispensing opening. Examples of different dispensing mechanisms are disclosed in U.S. Pat. No. 3,432,217 A, WO 2014/065733 A1, and WO 2013/007302 A2. In order to improve the dispensing process and make dispensers less prone to malfunction, the dispensing mechanisms for dispensing the sheet products have become more sophisticated over the past decades.

Among the various types of dispensers, there also exist dispensers having cabinets which are partially or completely recessed within a wall. However, many of these recessed cabinet dispensers, like the one disclosed in U.S. Pat. No. 3,432,217 A, are based on older dispensing mechanisms which have disadvantages compared to new technologies. It is therefore desirable to replace those dispensers with dispensers using newer dispensing mechanisms. Since recessed cabinets form part of a solid wall of a building, it is however expensive and time-consuming to replace existing recessed dispensers with new recessed dispensers using the latest technologies.

Therefore, there is a need to retrofit existing recessed dispenser cabinets with dispensers or dispensing mechanisms in a simple way.

SUMMARY

Hence, it is an object of the present disclosure to provide a dispenser device which can be installed in existing dispenser cabinets in a simple way and a method for installing the same.

The above-described problems are solved by the set according to embodiments of the application, the method according to embodiments of the application, and the dispenser according to embodiments of the application.

According to one aspect, a set for mounting a dispensing mechanism for dispensing sheet products within an existing dispenser cabinet that comprises a bottom wall having a dispensing opening, is disclosed. The existing dispenser cabinet may be partially or completely recessed within a wall. The set comprises the dispensing mechanism, wherein the dispensing mechanism comprises a lower portion, the lower portion comprising a first connection portion (which may also be referred to as "connecting portion"). The set comprises a mounting structure comprising a second connection portion (which may also be referred to as "connection portion") to which the first connection portion of the lower portion is attachable to support the dispensing mechanism. The mounting structure is fastenable to the bottom wall.

Since the mounting structure supports the dispensing mechanism and is fastenable to the bottom wall of the cabinet, it is possible to mount the dispensing mechanism within the cabinet in a simple way. In contrast to that, in state-of-the-art configurations, the dispensing mechanism is fastened to the rear wall of the cabinet. This is time-consuming and associated with difficulties because proper fastening positions at the rear wall of the cabinet have to be determined beforehand in order to ensure that the dispensing mechanism is located at the proper height.

In the present disclosure, the term "cabinet" refers to an existing cabinet. In contrast, the terms "dispensing mechanism" and "dispenser" of the present disclosure refer to devices to be mounted within such a cabinet.

The dispensing mechanism of the set according to the disclosure may be of the kind of or based on a dispensing mechanism in which sheet products are dispensed from the top of the stack, such as those disclosed in WO 2013/007302 A2 or WO 2014/065733 A1, the content of which is herewith incorporated in its entirety by reference. For this purpose, individual sheet products may be connected by lines of weakness (perforations) to form a web. Such a web may be guided within the dispensing mechanism with one or more than one guiding element, such as a roll or the like, in order to properly guide the web along a specific path to the dispensing opening of the cabinet. A web may also be provided without lines of weakness to form a homogeneous web from which individual sheet products may be separated by means of a cutting edge. Also other kinds of dispensing mechanisms are conceivable, such as dispensing mechanisms in which the sheet products are dispensed from the bottom of the stack. Moreover, sheet products may be individually provided.

In addition, the dispensing mechanism may also be a dispensing mechanism in which the sheet product is not provided in a stack, but rolled up on a roll or more than one roll. For example, the dispensing mechanism may comprise a roll or more than one roll and the sheet product may be a continuous web rolled up on the roll.

The cabinets, within which the dispensing mechanism can be mounted, may at least be partially recessed within a wall and may generally comprise a first side wall, a second side wall opposing the first side wall and a rear wall extending between the first side wall and the second side wall. In addition, existing recessed cabinets may be provided with a door for closing the recessed cabinet in order to protect the dispensing mechanism and improve the appearance of the dispenser. The door may be flush with the wall within which the recessed cabinet is arranged. As such, the recessed cabinet may be completely recessed within a wall. However, the recessed cabinet may also be only partially recessed within a wall while also protruding to some extent from the wall.

Furthermore, the cabinet comprises a bottom wall which has a dispensing opening. The bottom wall may be firmly attached to or integrally formed with the cabinet. In addition, various kinds and shapes of the bottom wall of the dispenser cabinets may exist. For example, the bottom wall may generally comprise a slanted or curved surface, as the one shown in U.S. Pat. No. 3,432,217 A, which may extend in an upward direction from the rear wall of the cabinet.

While the set and the dispenser according to the disclosure are exemplarily described in connection with an existing recessed cabinet, the set and the dispenser according to the disclosure may also be applied to a cabinet which is not recessed within a wall, but mounted to a wall or freestanding.

The dispensing mechanism of the set according to the disclosure comprises a lower portion. The lower portion may generally be understood as a portion of the dispensing mechanism being located at a lower position of the dispensing mechanism as seen in the up-down direction of the cabinet. According to an example, the dispensing mechanism may comprise a frame which is configured to be mounted in the cabinet. In this example, the lower portion may be a lower portion of the frame. The dispensing mechanism may also comprise more than one lower portion. For example, the frame of the dispensing mechanism may comprise a left side wall and a right side wall, wherein each of the left side wall and the right side wall comprises a lower portion.

The lower portion comprises a first connection portion. The first connection portion of the lower portion may be located at a lower end of the lower portion. In an example, the first connection portion may be located at the lower end of the frame of the dispensing mechanism.

The mounting structure of the set according to the disclosure may be understood as the structure with which the dispensing mechanism is mounted within the recessed cabinet.

For this purpose, the mounting structure comprises a second connection portion to which the first connection portion of the lower portion of the dispensing mechanism is attachable to support the dispensing mechanism. The second connection portion of the mounting structure may be specifically designed in order to provide proper connection between the second connection portion and the first connection portion of the dispensing mechanism of the set. In an example, the dispensing mechanism may comprise two lower portions, each of the two lower portions having a first connection portion. In this example, the mounting structure comprises two second connection portions to which the first connection portions of the lower portions are respectively attachable. The first connection portion may be inseparably attachable to the second connection portion. However, according to an example, the first connection portion may be detachably attachable to the second connection portion. With this configuration, it is possible to detach the dispensing mechanism from the mounting structure and, in turn, from the recessed cabinet, for example in order to perform maintenance, without having to detach the mounting structure from the cabinet.

The mounting structure supports the dispensing mechanism when the dispensing mechanism is attached to the mounting structure. This may imply that the mounting structure has sufficient rigidity in order to be able to support the dispensing mechanism.

Moreover, the mounting structure may be able to support the dispensing mechanism without the provision of further or other supporting means.

Furthermore, the mounting structure is fastenable to the bottom wall. The term "fastenable" may imply that the mounting structure is fastened to the bottom wall such that the mounting structure and, in turn, the dispensing mechanism is firmly mounted in the recessed cabinet. According to an example, the mounting structure may be located at an upper side of the bottom wall, as seen in the up-down direction of the cabinet, when being fastened to the bottom wall. As previously mentioned, the bottom wall of the recessed cabinet may differ in shape. Therefore, the mounting structure may generally be sized in order to properly fit to various shapes of the bottom wall, without covering the dispensing opening defined in the bottom wall in order not to hinder the sheet products from passing through the dispensing opening. The mounting structure may be inseparably fastened to the bottom wall. However, in an example, the mounting structure may be detachably fastenable to the bottom wall, for example, to also mount the mounting structure to another recessed cabinet.

In an example, the first connection portion may be non-pivotably attachable to the second connection portion.

However, the first connection portion may be pivotably attachable to the second connection portion.

As the first connection portion is comprised in the lower portion of the dispensing mechanism, "pivotably attachable" may mean that the dispensing mechanism can be pivoted about the mounting structure about an axis of rotation. For example, each part of the dispensing mechanism may be pivotably movable by the same angle of rotation about the axis of rotation. Alternatively, only specific parts of the dispensing mechanism may be pivotably movable. Pivotable attachment of the first connection portion to the second connection portion may be realized by means of hinges, a pin engaged with a hole, or the like.

With this configuration, it is possible to mount the dispensing mechanism in the recessed cabinet, even if the cabinet provides little space in the up-down direction of the cabinet.

More specifically, the cabinet may comprise a top wall opposing the bottom wall, wherein the space in the up-down direction of the cabinet is defined by the space between the bottom wall and the top wall. As mentioned previously, the mounting structure is fastenable to the bottom wall. Accordingly, if the mounting structure is fastened to the bottom wall and the dispensing mechanism is to be attached to the mounting structure, if the first connection portion would be non-pivotably attachable to the second connection portion of the mounting structure, the dispensing mechanism would be mounted to the recessed cabinet by arranging the dispensing mechanism in an upright position above the mounting structure within the recessed cabinet and subsequently lowering the dispensing mechanism in a downward direction in order to attach the first connection portion to the second connection portion. However, this lowering movement requires a certain space in the up-down direction within the recessed cabinet. Since, according to the disclosure, the first connection portion is pivotably attachable to the second connection portion, attaching the dispensing mechanism to the mounting structure does not require such lowering movement. In contrast, the dispensing mechanism may be attached to the mounting structure by attaching the first connection portion to the second connection portion with the dispensing mechanism being in a slanted position with respect to the rear wall of the cabinet and subsequently pivoting the dispensing mechanism into the cabinet.

The second connection portion may comprise a substantially cylindrical shape, wherein the first connection portion is substantially U-shaped and engageable with the second connection portion.

The expression "substantially cylindrical" may mean that not the entire shape of the second connection portion is cylindrical. For example, it may also be conceivable that only parts of the second connection portion comprise a cylindrical shape or that a cross section of the second connection portion or of parts thereof does not form a full circle. Furthermore, the expression "substantially U-shaped" may mean that not the entire first connection portion is U-shaped, but only parts thereof. Moreover, a cross section of the first connection portion or of parts thereof may not form a perfect U-shape but rather an open-circle shape or the like. The feature that the first connection portion is engageable with the second connection portion may mean that the U-shaped first connection portion can be brought into contact with the cylindrically shaped second connection portion such that the first connection portion and the second connection portion form a hinge-like mechanism which allows pivotable attachment of the first connection portion to the second connection portion.

With this configuration, it is possible to provide a pivotable attachment of the first connection portion to the second connection portion, thereby achieving the above-described advantages without the need of providing extra components, such as hinges or the like.

The dispensing mechanism may further comprise an upper portion, wherein the upper portion is attachable to the dispenser cabinet.

The upper portion of the dispensing mechanism may be an upper portion of the frame of the dispensing mechanism. However, also other parts of the dispensing mechanism located at an upper position of the dispensing mechanism in the up-down direction of the cabinet may be the upper portion. The upper portion may be attachable to the dispenser cabinet by means of adhesive tape, screws, hooks, hook and loop fastener, or the like. With this configuration, it is possible to additionally secure the dispensing mechanism within the recessed cabinet, i.e. in addition to supporting the dispensing mechanism by means of the mounting structure. For example, the first connection portion of the lower portion of the dispensing mechanism may be pivotably attached to the second connection portion of the mounting structure. In this case, using adhesive tape and/or hook and loop fastener, the upper portion of the dispensing mechanism may be attached to the dispenser cabinet upon pivoting the dispensing mechanism into the cabinet toward the rear wall thereof.

The upper portion may be attachable to the rear wall of the recessed cabinet. The upper portion may be attachable to the cabinet via additional attaching devices arranged between the dispensing mechanism and the wall of the cabinet. However, according to an example, the upper portion may be directly attachable to the dispenser cabinet, thereby reducing parts of the set for mounting a dispensing mechanism according to the disclosure.

The first connection portion may be snappable onto or into the second connection portion.

According to an example, the first connection portion may be made of a slightly flexible and elastic material, such as plastic or the like, and the U-shape or open-circle shape of the first connection portion may have a smaller diameter than the respective cylindrical shape of the second connection portion. In this case, the first connection portion may be attached to the second connection portion by pressing the first connection portion onto the second connection portion, thereby slightly pressing apart respective parts of the first connection portion forming the U-shape so as to increase the diameter of the U-shape and to allow connection to the second connection portion. Due to the flexible and elastic material of the first connection portion, said respective parts of the first connection portion forming the U-shape may be urged to return to their original position upon connection to the second connection portion, thereby snapping onto the second connection portion and completing connection.

The first connection portion may also be snappable into the second connection portion. For example, the first connection portion may comprise a protruding part and the second connection portion may comprise a hole, wherein the protruding part of the first connection portion is engageable with the hole of the second connection portion. Examples of such kind of connection may be a ball joint connection or a snap connection with spring-loaded hooks.

With this configuration, it is possible to improve attachment of the dispensing mechanism to the mounting structure compared to a case in which the first connection portion would not be snappable onto or into the second connection portion.

The mounting structure may comprise a fastening member fastenable to an edge of the dispensing opening.

The fastening member may be connected to the mounting structure. The fastening member may also be integrally formed with the mounting structure. It is also conceivable, that the fastening member is a separate element which is connectable or attachable to the mounting structure. Moreover, the mounting structure may also comprise more than one fastening member. For example, the mounting structure may comprise one fastening member, or two fastening members, or three fastening members, or four fastening members, or five fastening members.

In general, the fastening member may be fastenable to any edge of the dispensing opening, i.e. a front edge, a rear edge, or a side edge as seen with respect to the recessed cabinet.

With this configuration, it is possible to fasten the mounting structure to the bottom wall in a simple way and more reliably. This is because, on the one hand, a user can reach through the dispensing opening in fastening the mounting structure to the bottom wall, thereby having less handling difficulties in the mounting process. On the other hand, the fastening member can encompass the edge of the dispensing opening, thereby more reliably fastening the mounting structure to the bottom wall.

The fastening member may be fastenable to a rear edge of the dispensing opening.

The rear edge of the dispensing opening may be the edge which is located closest to the rear wall of the dispenser cabinet. In general, as described above, continuous dispensing of sheet products from the dispenser is realized by means of the dispensing mechanism ensuring that a protruding part of a leading sheet product protrudes through the dispensing opening and is easily graspable by a user. Since the protruding part covers or obscures the rear edge of the dispensing opening, the protruding part also covers or obscures the fastening member being fastenable to the rear edge of the dispensing opening.

Hence, with this configuration, a good appearance of the retrofitted dispenser can be obtained.

According to an example, the fastening member of the mounting structure is configured to be fastened to the bottom wall by structurally modifying the bottom wall. In this case, for example, the fastening member may comprise a screw with which the mounting structure is fastenable to the bottom wall, the screw thereby modifying the structure of the bottom wall by penetrating through the bottom wall.

However, the fastening member of the mounting structure may be configured to be fastened to the bottom wall without structurally modifying the bottom wall.

Structural modification of the bottom wall may comprise forming through holes in the bottom wall, for example in case the fastening member is fastened to the bottom wall by means of screws. Structural modification may also comprise modifying the overall shape of the bottom wall, for example by bending of the bottom wall. Structural modification may further comprise forming slits or the like in the bottom wall in order to fasten the fastening member to the bottom wall.

By providing a fastening member which is configured to be fastened to the bottom wall without structurally modifying the bottom wall, the dispensing mechanism can be mounted in the recessed cabinet in a simple way. Moreover, since the bottom wall is not structurally modified by the fastening member, damage of the bottom wall and/or the recessed cabinet can be prevented.

The fastening member may be selected from the group consisting of a clip, a clamp, a tape, a hook and loop fastener, and combinations thereof.

For example, the fastening member may be a clip, a clamp, a tape, or a hook and loop fastener. The fastening member may also be configured by a combination of a clip and a clamp or a clip and a tape and so on. The tape may be an adhesive tape. The clip and the clamp may be composed of several elements. For example, the clamp may comprise an eccentric-type quick-release mechanism being actuated by a lever.

Moreover, as mentioned above, the mounting structure may comprise more than one fastening member. In this case, more than one of the above elements of the group may be provided. For example, one clip, or two clips, or three clips, or four clips, or five clips may be provided.

With the fastening member being selected from the elements of the above group, the mounting structure can be easily fastened to the bottom wall. This is because no tool is required in order to fasten the elements of the above group to an edge of the dispensing opening. Moreover, since no tool is required, fastening the mounting structure to the bottom wall and, in turn, mounting the dispensing mechanism within the recessed cabinet can be performed more quickly.

The fastening member may be a clip, wherein the clip may comprise a spring clip having a substantially U-shaped cross section.

"Substantially U-shaped" may mean that not the entire cross section of the spring clip is U-shaped, but only parts thereof. Moreover, the cross section of the spring clip or of parts thereof may not form a perfect U-shape but also an open-circle shape, a shape comprising corners, or the like.

In an example, the spring clip may comprise two legs being connected or integrally connected to each other so as to form the U-shaped cross section. One leg may engage with the mounting structure and the other leg may engage with the edge of the dispensing opening so as to fasten the mounting structure to the bottom wall of the cabinet. The spring clip may be made of metal in order to provide proper spring properties so as to properly fasten the mounting structure to the bottom wall. However, the spring clip may also be made of plastic being flexible and elastic and having similar properties. In an example in which the spring clip may comprise two legs, the two legs may be spaced apart from each other by a certain distance in case the spring clip is in an unloaded state, i.e., when the mounting structure is not fastened to the bottom wall by means of the fastening member. In the example, the spring clip may be configured such that a loaded state of the spring clip is a state in which the two legs tend to urge towards each other, due to the spring force, if they are further spaced apart from each other compared to the unloaded state. The spring clip may be configured such that the spring clip is in the loaded state if one leg engages with the mounting structure and the other leg engages with an edge of the dispensing opening. In this case, the spring force exerted by the spring clip may fasten the mounting structure to the bottom wall of the recessed cabinet.

Hence, with this configuration, a simple structure and a simple mechanism of the fastening member can be provided.

The spring clip may also comprise more than two legs. For example, the spring clip may comprise three legs, wherein two legs may engage with the mounting structure and one leg may engage with the edge of the dispensing opening so as to fasten the mounting structure to the bottom wall of the cabinet.

The clip may further comprise a clip body having a substantially U-shaped cross section and encasing the spring clip.

"Substantially U-shaped" may have the same meaning as mentioned previously in context with the spring clip. In general, the clip body may be sized to encase the spring clip. For example, the clip body may be slightly larger in size so as to properly encase the spring clip. According to an example, the clip body may be made of plastic. With this configuration, it is possible to improve handling of the clips while fastening the mounting structure to the bottom wall. Moreover, it is possible to provide a more stable configuration of the clip.

Furthermore, the clip body may comprise grooves or other structures on the outside thereof. These structures may enhance grip between the clip and a user's hand, while fastening the mounting structure to the bottom wall.

The mounting structure may comprise one or more than one slot opening. The slot opening may have a slot length along its longitudinal axis, wherein the clip body may comprise two legs, wherein one of the two legs may penetrate the slot opening. The one of the two legs may comprise a protrusion portion which may extend in a direction parallel to the longitudinal axis of the slot opening and which may have a length longer than the slot length.

The mounting structure may comprise one slot opening or more than one slot opening. In an example, the mounting structure may comprise two slot openings. However, the mounting structure may also comprise more than two slot openings, for example, three slot openings, four slot openings, or five slot openings. The slot opening may be preformed in the mounting structure. As generally implied by the term "slot opening", the slot opening may have a longitudinal shape, like a slit, or a groove, or the like. Hence, the slot opening has a slot length along its longitudinal axis.

Similar to the above-described example with respect to the spring clip, the clip body encasing the spring clip comprises two legs. In an example, the legs are formed integrally, so as to follow the shape of the spring clip. One of the two legs of the clip body penetrates the slot opening. In an example, the one of the two legs penetrating the slot opening may penetrate the slot opening in such a way that the clip may be displaced or moved relative to the mounting structure in a direction along the leg of the clip without the slot opening hindering the movement of the clip. In addition, the one of the two legs may penetrate the slot opening in such a way that the clip may be displaced to some extent relative to the mounting structure in the up-down direction and/or in the left-right direction of the cabinet when the mounting structure is arranged or placed on the bottom wall of the cabinet. Furthermore, the one of the two legs may penetrate the slot opening in such a way that the clip may be rotated to some degrees relative to the mounting structure in any direction, for example about an axis of rotation parallel to the front-rear direction of the cabinet, and/or about an axis of rotation parallel to the left-right direction of the cabinet, and/or about an axis of rotation parallel to the up-down direction of the cabinet, when the mounting structure is arranged or placed on the bottom wall of the cabinet. With this configuration, the clip can be optimally oriented with respect to the shape of the rear edge of the dispensing opening of the bottom wall, thereby optimizing fastening of the mounting structure to the bottom wall of the cabinet.

The one of the two legs which penetrates the slot opening comprises a protrusion portion. The protrusion portion may be an extra element connected to the one of the two legs or may be integrally formed with the one of the two legs. Furthermore, the protrusion portion may form an end portion of the one of the two legs.

With this configuration, since the protrusion portion extends in a direction parallel to the longitudinal axis of the slot opening and has a length longer than the slot length, the clip can be prevented from moving out of the slot opening of the mounting structure. This prevents losing the clips when the mounting structure is not fastened to the bottom wall, for example during transport. Moreover, fastening of the mounting structure to the bottom wall of the cabinet can be facilitated because the clips do not have to be separately held by a user.

The clip body may also comprise more than two legs, for example in cases in which the spring clip comprises more than two legs. For example, the clip body may comprise three legs in case the spring clip comprises three legs.

The mounting structure may be substantially bar-shaped.

"Bar-shaped" may have the same meaning as "rod-shaped" and may mean that the mounting structure has an elongated shape. The term "substantially" may indicate that the elongated shape of the mounting structure does not necessarily have to be completely straight. The cross section of the mounting structure may have a rectangular, trapezoidal, round, square, or any other shape which is configured to properly fasten the mounting structure to the bottom wall.

With this configuration, it is possible to provide a simple mounting structure for mounting the dispensing mechanism within the recessed cabinet, wherein the mounting structure does not cover the dispensing opening defined in the bottom wall of the cabinet.

The mounting structure may be adjustable in length in its longitudinal direction.

In order to adjust the length of the mounting structure, additional elements having the same cross-section as the mounting structure may be connected to end portions of the mounting structure so as to increase the length in the longitudinal direction of the mounting structure. Furthermore, it is also conceivable that the mounting structure is telescopically adjustable in length. In this case, the adjusted length of the mounting structure may be fixed via a screw mechanism between the respective telescopic parts of the mounting structure.

With this configuration, it is possible to adapt the length of the mounting structure to the shape of the recessed cabinet, thereby providing an improved fixing of the mounting structure and, in turn, of the dispensing mechanism within the recessed cabinet.

According to another aspect, a method for mounting a dispensing mechanism for dispensing sheet products within an existing dispenser cabinet that comprises a bottom wall having a dispensing opening, is disclosed. The method comprises the steps of:

i) placing a mounting structure comprising a second connection portion on the bottom wall, ii) fastening the mounting structure to the bottom wall, iii) attaching a first connection portion provided at a lower portion of the dispensing mechanism to the second connection portion of the mounting structure.

The dispensing mechanism may be the same or may have the same features as the dispensing mechanism of the present disclosure. Also the existing dispenser cabinet may be the same or may have the same features as the recessed cabinet mentioned previously.

Throughout this document, the expression "may have the same features" may also mean that only some of the features are the same, while others are different.

In step i), a mounting structure which comprises a second connection portion is placed on the bottom wall of the recessed cabinet. The mounting structure may be the same or may have the same features as the mounting structure of the present disclosure. In this step, the mounting structure may be placed on the bottom wall and its position may be adjusted with respect to the dispensing opening so as to ensure proper placement of the mounting structure.

In step ii), the mounting structure is fastened to the bottom wall. For example, this step may comprise fastening the mounting structure to the bottom wall by means of the clip of the present disclosure as described above. This step may be performed subsequent the step i). With this step, the position of the mounting structure with respect to the bottom wall is fixed.

In step iii), the first connection portion of the dispensing mechanism is attached to the second connection portion of the mounting structure. Attaching the first connection portion of the dispensing mechanism to the second connection portion of the mounting structure may include snapping the first connection portion onto or into the second connection portion. Furthermore, attaching the first connection portion to the second connection portion may be performed while the dispensing mechanism is in an upright position or in a slanted position with respect to the rear wall of the cabinet.

With this method, it is possible to easily mount a dispensing mechanism within an existing recessed dispenser cabinet. Hence, the method is suitable for retrofitting an existing recessed cabinet with a dispensing mechanism having a newer technology.

The first connection portion may be pivotably attachable to the second connection portion, wherein the method subsequent the step iii) may further comprise the step of:

iv) pivoting the dispensing mechanism into the dispenser cabinet.

The pivotable attachment of the first connection portion to the second connection portion may be the same or may have the same features as described above. In step iv), due to the pivotable attachment of the first connection portion to the second connection portion, the dispensing mechanism may be attached to the mounting structure while being in a slanted position with respect to the rear wall of the recessed cabinet and subsequently pivoted into the recessed cabinet.

Thus, with this method, it is possible to readily mount the dispensing mechanism within the recessed cabinet also in cases in which the space of the recessed cabinet between the bottom wall and the top wall thereof is reduced.

The method subsequent the step iv) may further comprise the step of:

v) attaching an upper portion of the dispensing mechanism to the dispenser cabinet.

The upper portion of the dispensing mechanism may be the same or may have the same features as described above. Also the attachment of the upper portion to the dispenser cabinet may be characterized by the same features as described above.

With this method, it is possible to additionally secure the dispensing mechanism within the recessed cabinet, i.e. in addition to attaching the dispensing mechanism to the mounting structure. For example, the first connection portion of the dispensing mechanism may be pivotably attached to the second connection portion of the mounting structure. In this case, using adhesive tape and/or hook and loop fastener, the upper portion of the dispensing mechanism may be attached to the dispenser cabinet upon pivoting the dispensing mechanism into the cabinet toward the rear wall thereof.

According to another aspect, a dispenser for being mounted within an existing dispenser cabinet that comprises a bottom wall having a dispensing opening, is disclosed. The existing dispenser cabinet may be a recessed cabinet and for example be partially or completely recessed within a wall. The dispenser comprises a first side wall, a second side wall opposing the first side wall, a rear wall extending between the first side wall and the second side wall and a lower wall structure being connected to the lower ends of the first side wall, the second side wall, and the rear wall. The first side wall, the second side wall, the rear wall, and the lower wall structure form a storage compartment for accommodating a stack of sheet products. The lower wall structure defines a dispensing outlet for dispensing the sheet products. The lower wall structure is fastenable to the bottom wall.

Since the lower wall structure is fastenable to the bottom wall of the cabinet, it is possible to mount the dispenser within the recessed cabinet in a simple way. In contrast to that, in state-of-the-art configurations, the dispenser or dispensing mechanism is fastened to the rear wall of the recessed cabinet. This is time-consuming and associated with difficulties because proper fastening positions at the rear wall of the cabinet have to be determined beforehand in order to ensure that the dispensing mechanism is located at the proper height.

The existing dispenser cabinet may be the same or may have the same features as the (recessed) cabinet mentioned previously.

The dispenser may be of the kind of or based on the dispenser disclosed in WO 2014/200394 A1, the content of which is herewith incorporated in its entirety by reference. The dispenser disclosed in WO 20014/200394 A1 comprises a dispensing mechanism in which the sheet products are dispensed through the dispensing outlet from the bottom of the stack of sheet products. In an example, when being mounted in the recessed cabinet, the first side wall of the dispenser may be arranged adjacent to the first side wall of the cabinet, the second side wall of the dispenser may be arranged adjacent to the second side wall of the cabinet, and the rear wall of the dispenser may be arranged adjacent to the rear wall of the cabinet. Moreover, in the example, the lower wall structure may be arranged adjacent to the bottom wall of the recessed cabinet. For this purpose, the lower wall structure may be sized and/or shaped to be compatible with the shape of the bottom wall of the cabinet. This may mean that the dispensing outlet of the lower wall structure is aligned with the dispensing opening of the bottom wall of the cabinet.

The first side wall, the second side wall, the rear wall, and the lower wall structure of the dispenser form a storage compartment for accommodating a stack of sheet products. The storage compartment may be large enough for receiving the stack of sheet products without inhibiting the movement of the sheet products when the sheet products are dispensed. According to an example, the storage compartment may be sized for accommodating more than one stack of sheet products. Moreover, the dispenser may also be provided with a front wall or front wall portions extending on a front side of the dispenser between the first side wall and the second side wall of the dispenser so as to limit the storage compartment in the front direction of the cabinet.

As previously mentioned, the lower wall structure defines a dispensing outlet for dispensing the sheet products. In an example, as shown in FIG. 2 of WO 2014/200394 A1, the rear wall as well as the lower wall structure of the dispenser may be composed of two parts which are movably arranged relative to each other such that the space of the storage compartment can be adapted in the direction from the first side wall to the second side wall of the dispenser, i.e. in a left-right direction of the recessed cabinet. This configuration allows for an adaption of the dispenser to the size of the sheet products. In this example, the dispensing outlet of the dispenser is defined by the two parts of the lower wall structure. Moreover, as previously mentioned, the dispensing outlet of the dispenser may generally be aligned with the dispensing opening of the cabinet in order to ensure proper dispensing of the sheet products from the dispenser through the dispensing opening of the cabinet.

According to this aspect of the disclosure, the lower wall structure is fastenable to the bottom wall. The fastening of the lower wall structure to the bottom wall may be the same or may have the same features as the fastening of the mounting structure to the bottom wall as mentioned above with respect to the set for mounting the dispensing mechanism within the recessed cabinet according to the other aspect of the disclosure.

The rear wall may be attachable to the dispenser cabinet.

The attachment of the rear wall of the dispenser to the dispenser cabinet, that is the recessed dispenser cabinet, may be the same or may have the same features as the attachment of the upper portion of the dispensing mechanism to the dispenser cabinet described above. Accordingly, the rear wall of the dispenser may be attachable to the recessed cabinet by means of adhesive tape, hook and loop fastener, or the like. Furthermore, only an upper portion of the rear wall of the dispenser may be attachable to the recessed dispenser cabinet.

With this configuration, it is possible to additionally secure the dispenser within the recessed cabinet, i.e. in addition to fastening the dispenser to the cabinet by fastening the lower wall structure to the bottom wall of the cabinet.

The lower wall structure may comprise a fastening member fastenable to an edge of the dispensing opening.

The fastening member may be the same or may have the same features as the fastening member described above with respect to the mounting structure. Accordingly, the fastening member may be connected to the lower wall structure. The fastening member may also be integrally formed with lower wall structure. It is also conceivable, that the fastening member is a separate element which is connectable or attachable to the lower wall structure. Moreover, the lower wall structure may also comprise more than one fastening member.

With this configuration, it is possible to fasten the lower wall structure to the bottom wall in a simple way and more reliably.

The fastening member may be fastenable to a rear edge of the dispensing opening.

Fastening of the fastening member of the lower wall structure to the rear edge of the dispensing opening may be the same or may have the same features as fastening of the fastening member of the mounting structure to the rear edge as described above.

Hence, with this configuration, a good appearance of the retrofitted dispenser can be obtained.

The fastening member of the lower wall structure may be configured to be fastened to the bottom wall without structurally modifying the bottom wall.

Fastening of the fastening member of the lower wall structure to the bottom wall without structurally modifying the bottom wall may be the same or may have the same features as fastening of the fastening member of the mounting structure to the bottom wall described above.

By providing a fastening member which is configured to be fastened to the bottom wall without structurally modifying the bottom wall, the dispenser can be mounted in the recessed cabinet in a simple way. Moreover, since the bottom wall is not structurally modified by the fastening member, damage of the bottom wall and/or the recessed cabinet can be prevented.

The fastening member may be selected from the group consisting of a clip, a clamp, a tape, a hook and loop fastener, and combinations thereof.

The clip, the clamp, the tape, the hook and loop fastener, and combinations thereof may be the same or may have the same features as the respective elements described in connection with the fastening member of the mounting structure of the present disclosure.

Accordingly, with the fastening member being selected from the elements of the above group, the lower wall structure can be easily and quickly fastened to the bottom wall.

The fastening member may be a clip, wherein the clip may comprise a spring clip having a substantially U-shaped cross section.

The spring clip may be the same or may have the same features as the spring clip described above with respect to the fastening member of the mounting structure.

Hence, with this configuration, a simple structure and a simple mechanism of the fastening member can be provided.

The clip may further comprise a clip body having a substantially U-shaped cross section and encasing the spring clip.

The clip body may be the same or may have the same features as the clip body described above with respect to the fastening member of the mounting structure.

Accordingly, with this configuration, it is possible to improve handling of the clip while fastening the lower wall structure to the bottom wall. Moreover, it is possible to provide a more stable configuration of the clip.

The lower wall structure may comprise one or more than one slot opening. The slot opening may have a slot length along its longitudinal axis, wherein the clip body may comprise two legs, wherein one of the two legs may penetrate the slot opening. The one of the two legs may comprise a protrusion portion which may extend in a direction parallel to the longitudinal axis of the slot opening and which may have a length longer than the slot length.

The slot opening of the lower wall structure may be the same or may have the same features as the slot opening of the mounting structure described above. Accordingly, the lower wall structure may comprise one slot opening or more than one slot opening. In an example, the lower wall structure may comprise two slot openings. However, the lower wall structure may also comprise more than two slot openings, for example, three slot openings, four slot openings, or five slot openings. The slot opening may be preformed in the lower wall structure.

Generally, in order to provide the slot opening in the lower wall structure, the lower wall structure may comprise a portion or portions comprising a certain thickness and/or a certain depth. In an example, this portion or these portions may be provided at an edge or at a rear edge of the dispensing outlet defined in the lower wall structure.

With this configuration, since the protrusion portion extends in a direction parallel to the longitudinal axis of the slot opening and has a length longer than the slot length, the clip can be prevented from moving out of the slot opening of the lower wall structure. This prevents losing the clips when the dispenser is not fastened to the bottom wall, for example during transport. Moreover, fastening of the dispenser to the bottom wall of the cabinet can be facilitated because the clips do not have to be separately held by a user.

Further aspects of the present disclosure may be found in the following description of particular embodiments making reference to the accompanying drawings.

DETAILED DESCRIPTION OF PARTICULAR EMBODIMENTS

Figure 1:
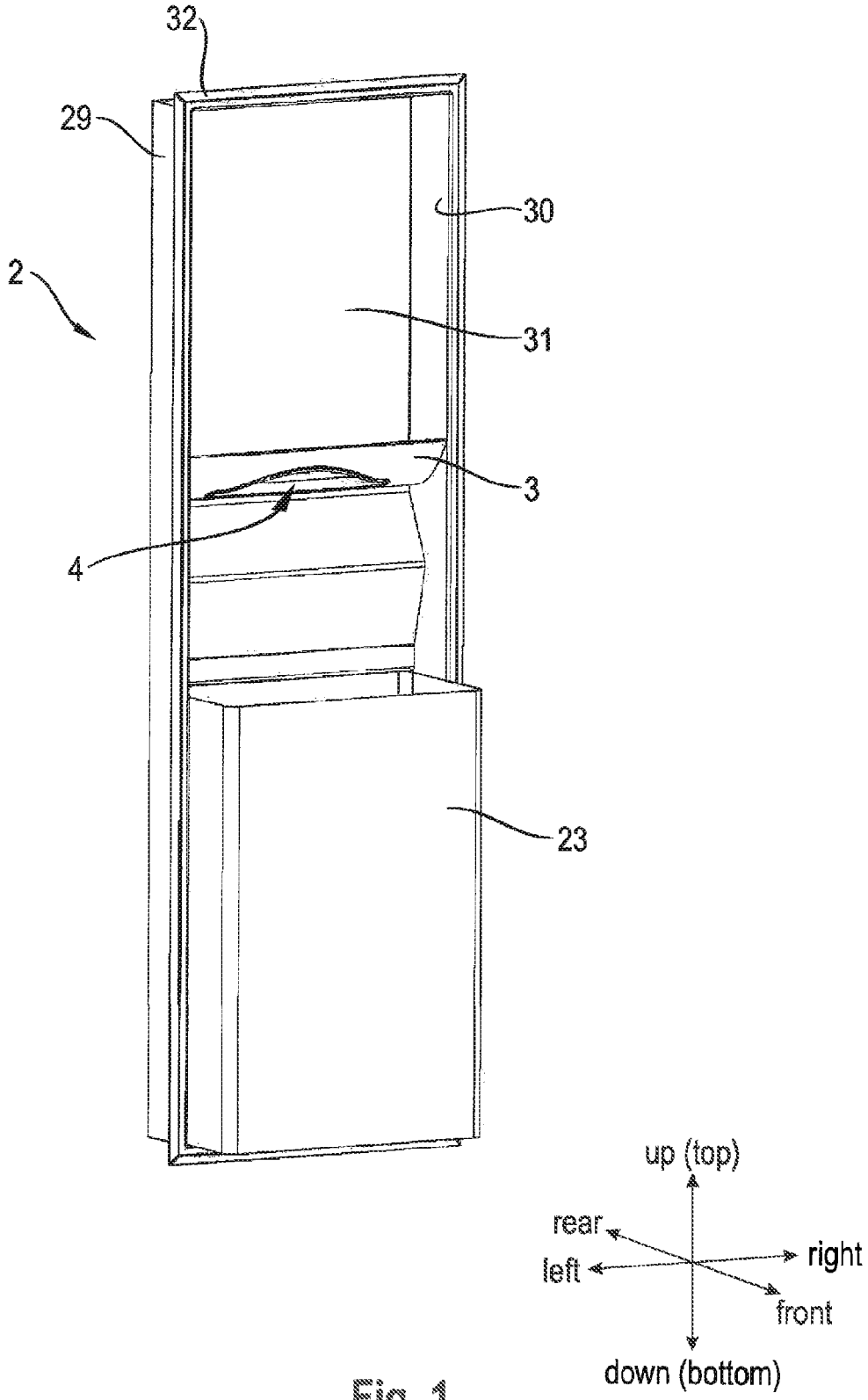
FIG. 1 is a perspective front view of a recessed dispenser cabinet.

Hereinafter, embodiments according to the disclosure will be described in detail with reference to the accompanying drawings in order to describe the disclosure using illustrative examples. Further modifications of certain individual features described in this context can be combined with other features of the described embodiments to form further embodiments of the disclosure.

Throughout the drawings, the same reference numerals are used for the same elements.

FIG. 1 is a perspective front view of a recessed dispenser cabinet 2 in which the dispensing mechanism 1 of the present disclosure can be mounted. The recessed cabinet 2 comprises a first side wall 29, a second side wall 30 opposing the first side wall 29 and a rear wall 31 extending between the first side wall 29 and the second side wall 30. Moreover, the recessed cabinet 2 is provided with an abutting portion 32 which is configured to abut on the wall when the cabinet 2 is installed in the wall. The recessed cabinet 2 comprises a bottom wall 3 which is attached to the cabinet 2 and in which a dispensing opening 4 is provided. In the embodiment shown in FIG. 1, the recessed cabinet 2 further comprises a bin 23 which is for disposal of used sheet products.

Figure 2:
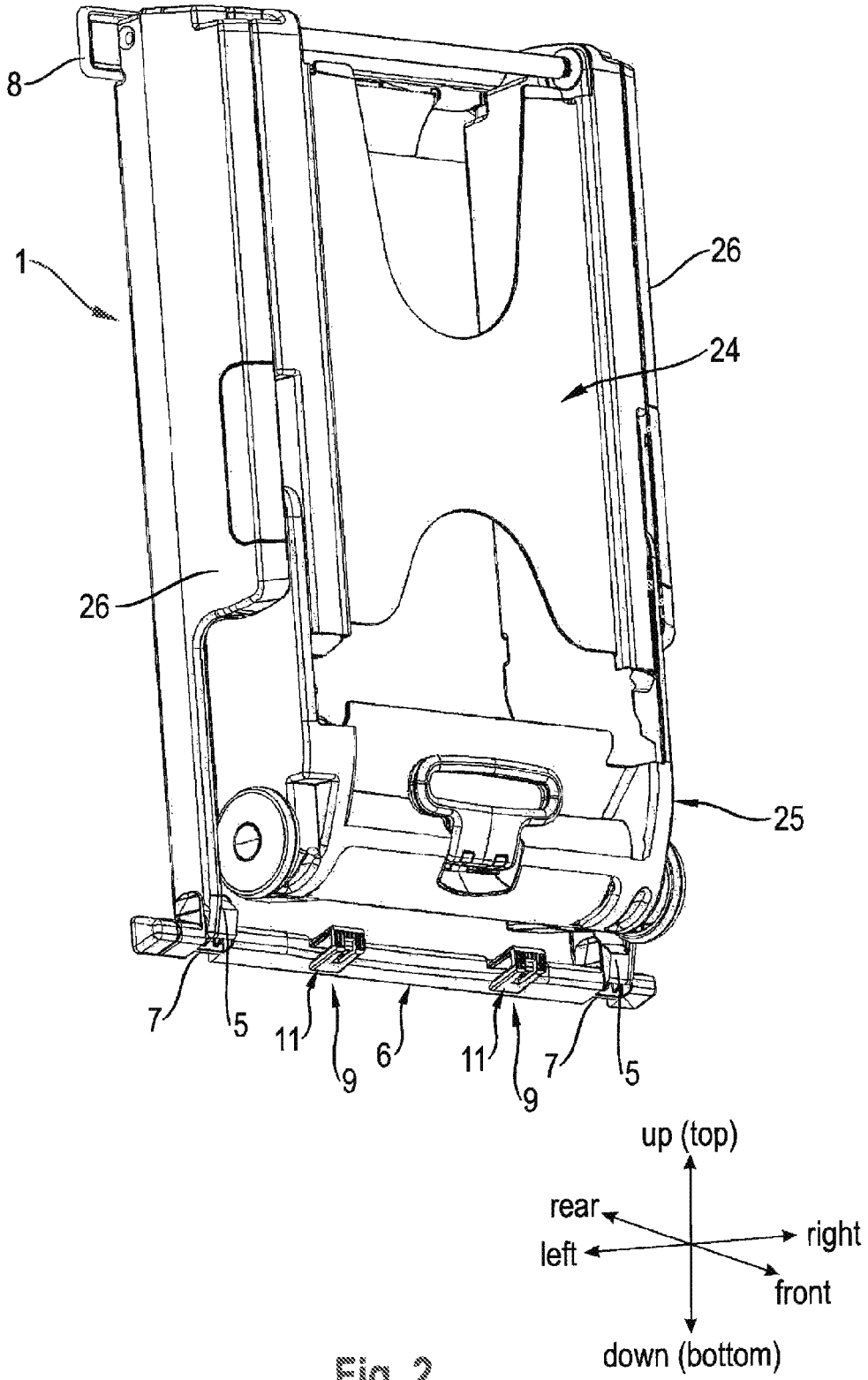
FIG. 2 is a perspective front view of a set comprising a dispensing mechanism according to an embodiment and a mounting structure according to a first embodiment.

FIG. 2 is a perspective front view of the set of the present disclosure comprising the dispensing mechanism 1 according to an embodiment and the mounting structure 6 according to a first embodiment. The dispensing mechanism 1 comprises a magazine part 24 for accommodating a stack of sheet products and a dispensing part 25 for dispensing the sheet products. In the dispensing mechanism 1 of this embodiment, the sheet products are dispensed from the top of the stack. The magazine part 24 and the dispensing part 25 are respectively attached to a frame 26 of the dispensing mechanism 1. The frame 26 comprises a left side wall and a right side wall, respectively connected to the left side and the right side of the magazine part 24 and the dispensing part 25. The dispensing mechanism comprises an upper portion 8 located at an upper end portion of the frame 26. Each of the left side wall and the right side wall of the frame 26 comprises a lower portion, the lower portion comprising a first connection portion 5. Each of the first connection portions 5 is attached to a second connection portion 7 of the mounting structure 6.

The mounting structure 6 is bar-shaped and comprises an elongated shape extending in the left-right direction with respect to the recessed cabinet 2. Furthermore, the mounting structure 6 according to the first embodiment comprises two clips 11 as fastening members 9 for fastening the mounting structure 6 to the bottom wall 3 of the dispenser cabinet 2.

Figure 3:
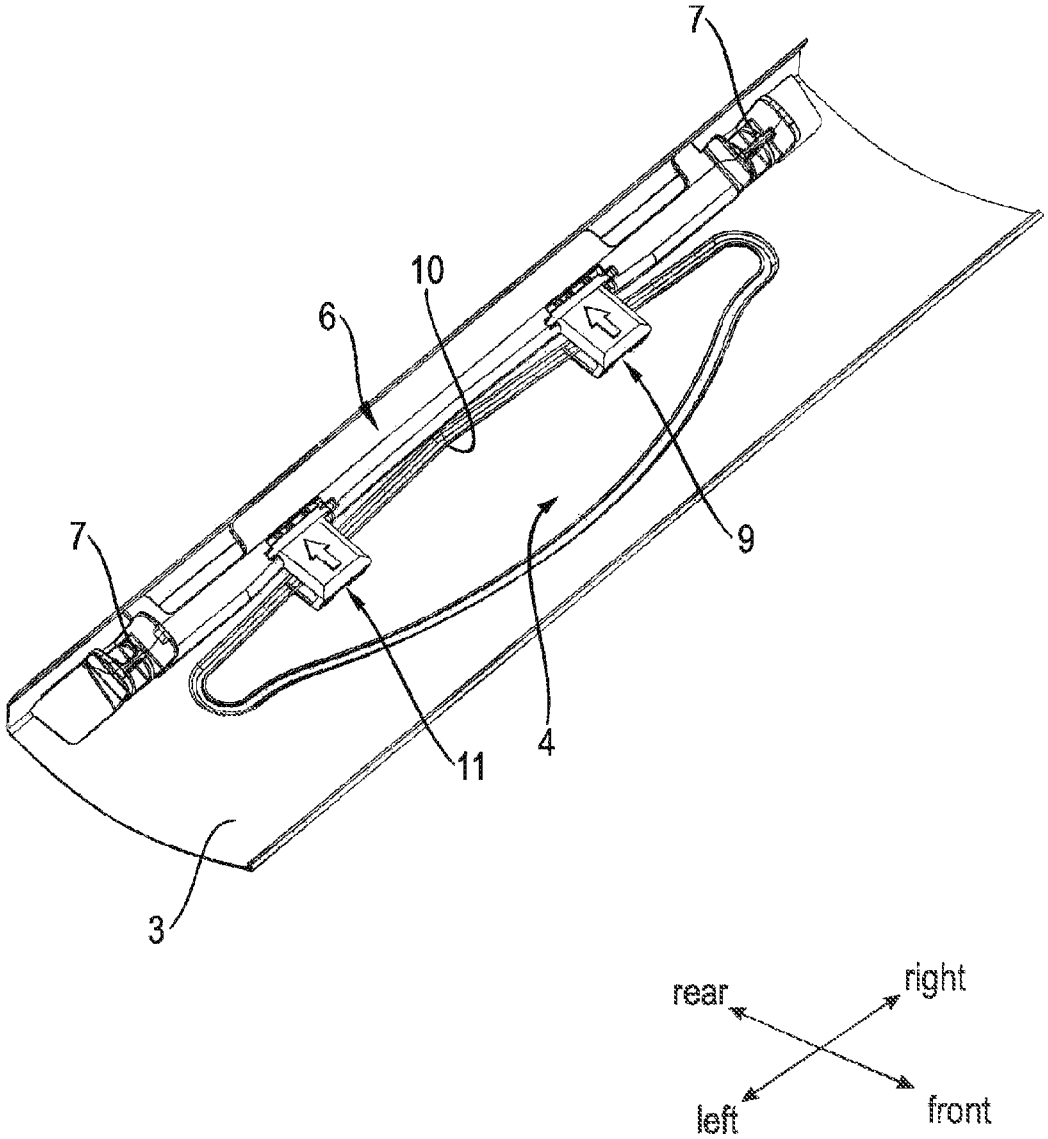
FIG. 3 is a perspective top view of the mounting structure of the first embodiment being fastened to the bottom wall of the recessed dispenser cabinet of FIG. 1.

FIG. 3 is a perspective top view of the mounting structure 6 of the first embodiment being fastened to the bottom wall 3 of the recessed dispenser cabinet 2 of FIG. 1. As can be seen, the length of the mounting structure 6 in the left-right direction is almost as long as the length of the bottom wall 3 and the left-right direction. The mounting structure 6 is sized so as to fit to a rear portion of the bottom wall 3 located between the rear edge 10 of the dispensing opening 4 and the rear end of the bottom wall 3. With this configuration, the mounting structure 6 does not cover the dispensing opening 4 of the bottom wall 3. Furthermore, the clips 11 are configured to be fastenable to the rear edge 10 of the dispensing opening 4. Therefore, when the sheet products are dispensed through the dispensing opening 4, a protruding part of the leading sheet product will obscure the clips 11, thereby obtaining improving good appearance of the recessed dispenser.

As can be seen, the second connection portion 7 of the mounting structure comprises a substantially cylindrical shape. More specifically, only certain parts of the second connection portion 7 comprise the cylindrical shape. In addition, in this embodiment, the clips 11 are provided with arrow markings, wherein the arrows point into the direction in which the clips 11 have to be moved in order to fasten the mounting structure 6 to the bottom wall 3.

Figure 4:
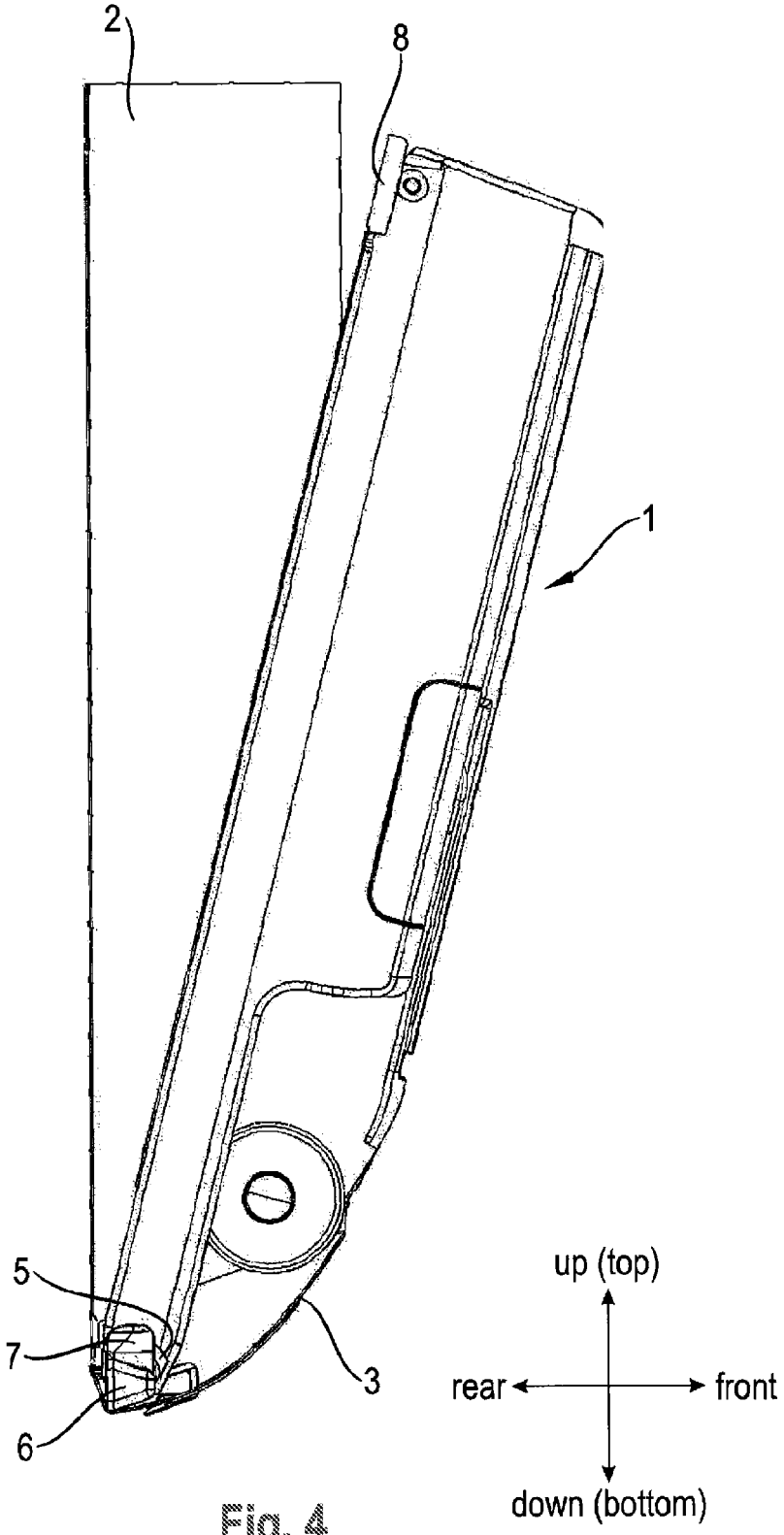
FIG. 4 is a side view of the set of FIG. 2, wherein the mounting structure is fastened to the bottom wall, while the dispensing mechanism is in a slanted position.

FIG. 4 is a side view of the set of FIG. 2, wherein the mounting structure 6 is fastened to the bottom wall 3, while the dispensing mechanism 1 is in a slanted position with respect to the recessed cabinet 2. In this case, the first connection portion 5 of the dispensing mechanism 1 is pivotably attachable to the second connection portion 7 of the mounting structure 6. With this configuration, it is possible to first fasten the mounting structure 6 to the bottom wall 3 and subsequently attach the dispensing mechanism 1 to the mounting structure 6. Then, the dispensing mechanism can be readily pivoted into the recessed cabinet 2. Optionally, the upper portion 8 of the dispensing mechanism 1 can be attached to the rear wall of the recessed cabinet 2.

Figure 5:
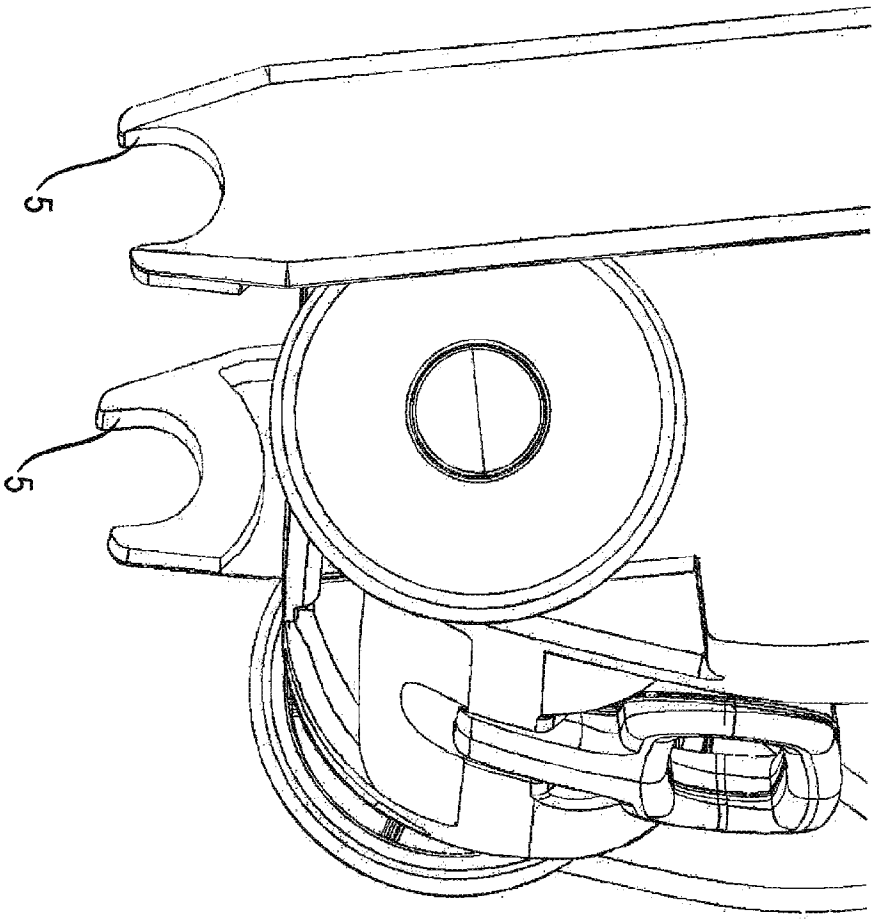
FIG. 5 is a perspective lower view of the first connection portion of the dispensing mechanism of FIG. 2.

FIG. 5 is a perspective lower view of the first connection portion 5 of the dispensing mechanism 1 of FIG. 2. As can be seen, the first connection portion 5 comprises a U-shape which is configured to be engageable with the respective cylindrical shape of the second connection portion 7 of the mounting structure 6. Hence, with this configuration, it is possible to pivot the dispensing mechanism 1 about the mounting structure 6.

Figure 6:
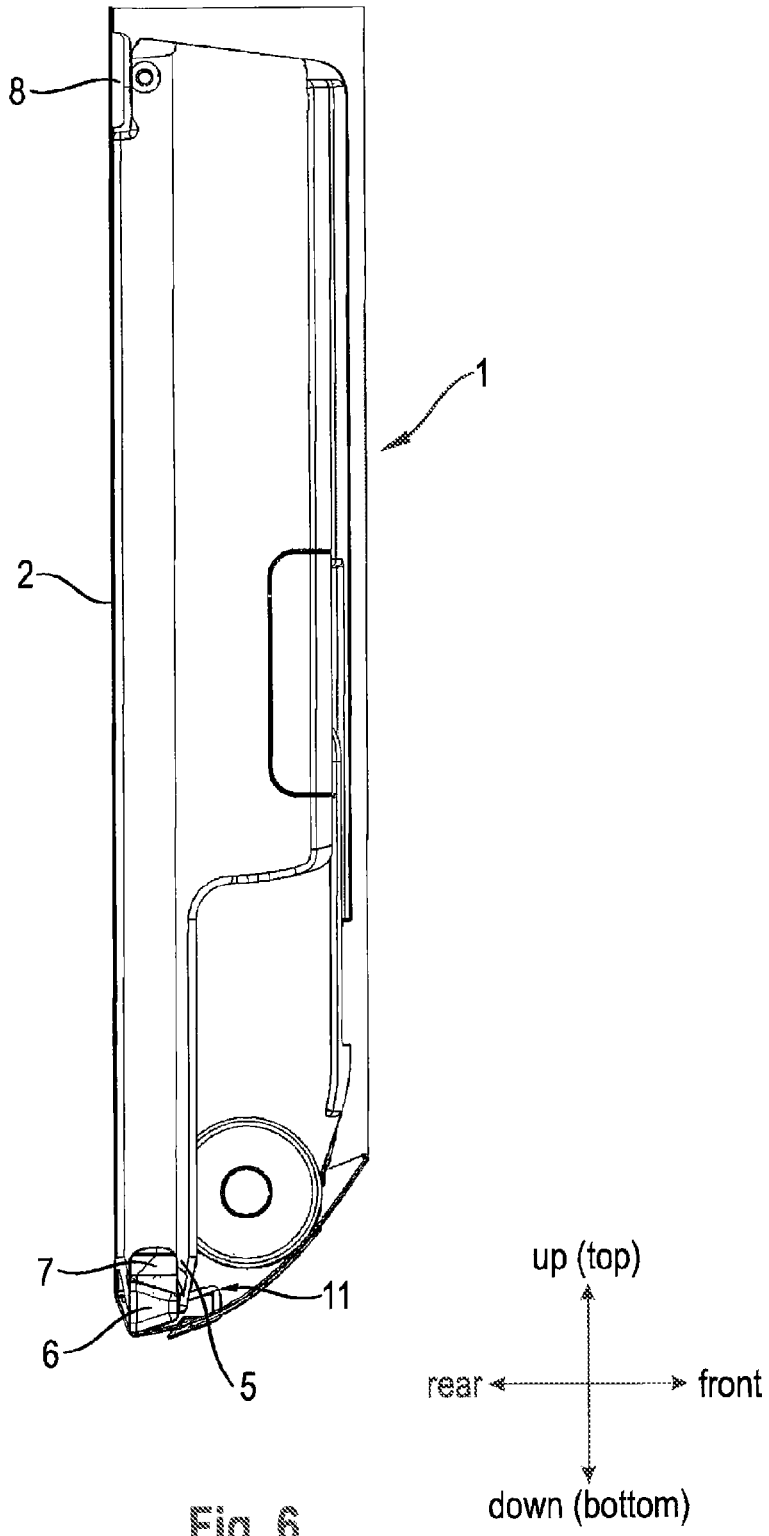
FIG. 6 is a side view of the set of FIG. 2 being mounted within the recessed cabinet of FIG. 1.

FIG. 6 is a side view of the set of FIG. 2 being mounted within the recessed cabinet 2 of FIG. 1. In this case, the dispensing mechanism 1 may have been pivoted into the recessed cabinet 2. As can be seen, the whole dispensing mechanism 1 is supported by the mounting structure 6 and no further mounting means, except for the optional attachment of the upper portion 8 to the dispenser cabinet 2, is required for mounting the dispensing mechanism 1 in the recessed cabinet 2.

Figure 7:
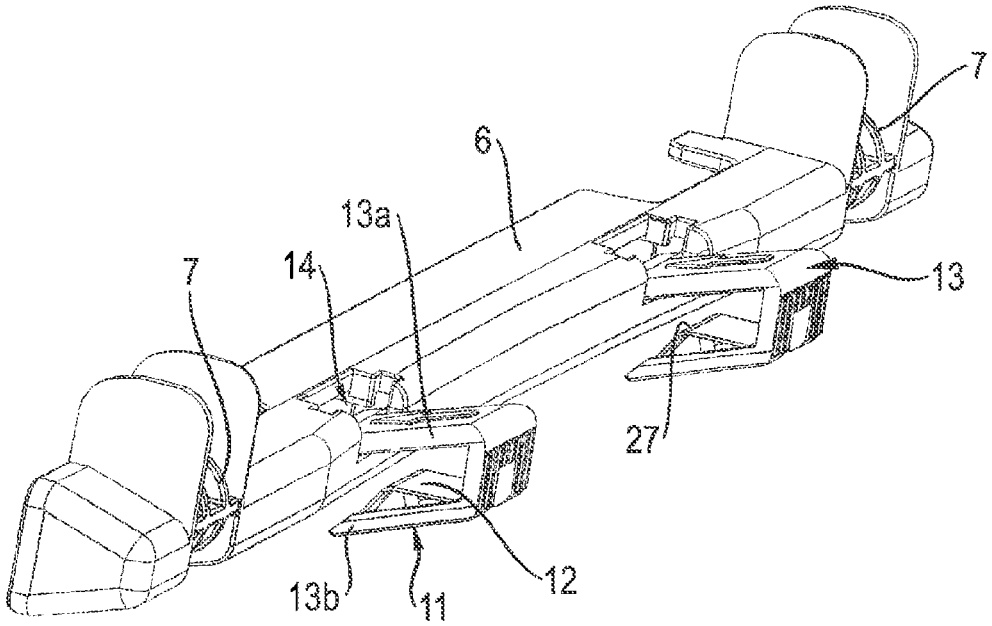
FIG. 7 is a perspective view of the mounting structure of the first embodiment.
Figure 9:
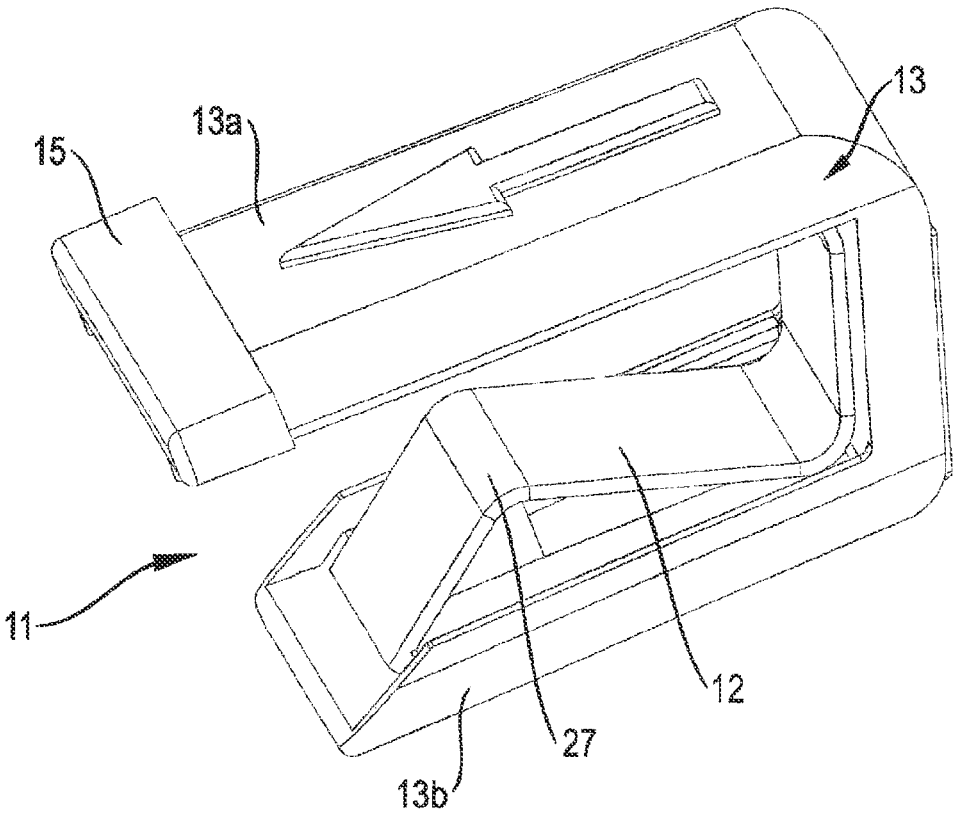
FIG. 9 is a perspective view of a clip of the mounting structure of the first embodiment.

FIG. 7 is a perspective view of the mounting structure 6 of the first embodiment. FIG. 9 is a perspective view of the clip 11 of the mounting structure 6 of the first embodiment. The clip 11 comprises a spring clip 12 and a clip body 13 encasing the spring clip 12. The clip body 13 and the spring clip 12 respectively have a U-shape. The clip body 13 comprises two legs 13*a*, 13*b* integrally connected with each other so as to form the U-shape of the clip 11.

As can be seen in FIG. 7, the mounting structure 6 comprises slot openings 14. One of the two legs 13*a* penetrates the slot opening 14 of the mounting structure 6. The one of the two legs 13*a* comprises a protrusion portion integrally formed with the leg 13*a*, as can be seen in FIG. 9. The other of the two legs 13*b* is arranged at a lower position in the up-down direction of the recessed cabinet 2 compared to the mounting structure 6. When being fastened to the bottom wall 3, the mounting structure 6 is arranged on a top side of the bottom wall 3, while the other of the two legs 13*b* is arranged on the bottom side of the bottom wall 3, as seen in the up-down direction. Moreover, the leg of the spring clip 12 arranged adjacent to the other of the two legs 13*b* may comprise a bent portion 27 which, when the mounting structure 6 is fastened to the bottom wall 3, abuts on the bottom side of the bottom wall 3. The mounting structure 6 is fastened to the bottom wall 3 by placing the mounting structure 6 on a rear portion of the bottom wall 3 and pushing the clips 11 into the rear direction, i.e. the direction indicated by the arrow marking on the clip body 13, which causes the clips 11 to encompass the rear edge 10 of the dispensing opening 4. In this state, the spring clip 12 is in a loaded state, thereby pressing and fastening the mounting structure to the bottom wall 3.

Figure 10:
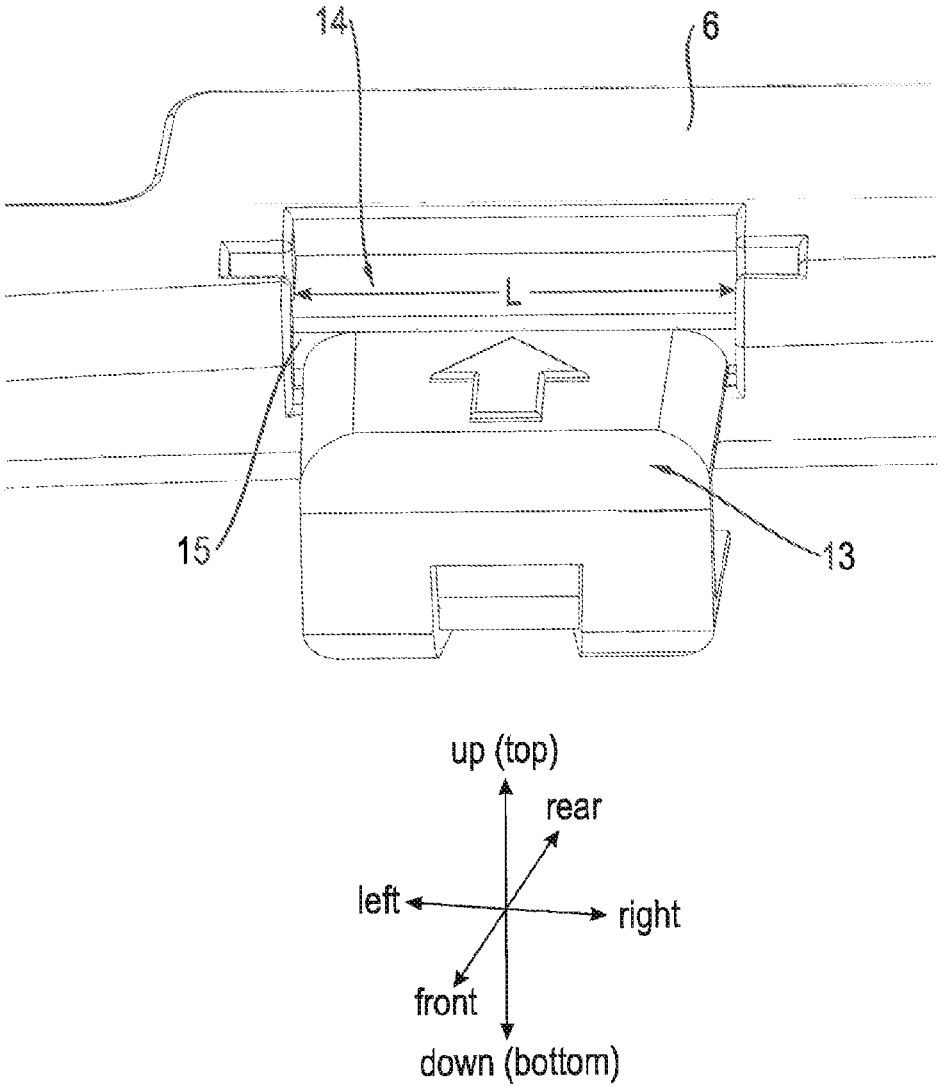
FIG. 10 is a perspective front view of the mounting structure of the first embodiment, wherein the clip of FIG. 9 penetrates a slot opening.
Figure 11:
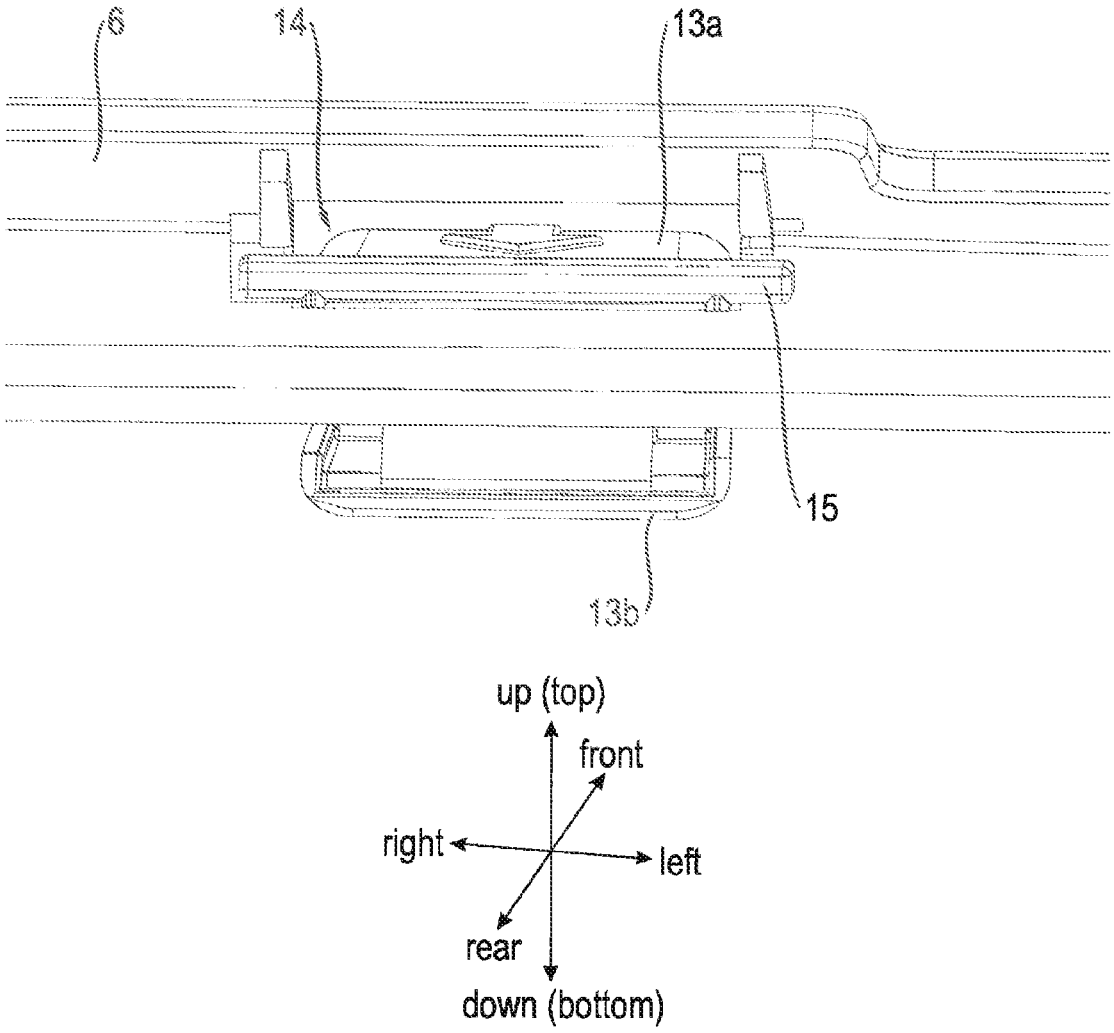
FIG. 11 is a perspective rear view of the mounting structure of the first embodiment, wherein the clip of FIG. 9 penetrates the slot opening.

FIGS. 10 and 11 illustrate how the clip 11 is connected to the mounting structure 6. While FIG. 10 is a perspective front view of the mounting structure 6 of the first embodiment, wherein the clip 11 of FIG. 9 penetrates a slot opening 14, FIG. 11 is a perspective rear view thereof. As can be seen in FIG. 10, the slot opening 14 of the mounting structure 6 has an elongated shape having a longitudinal axis corresponding to the left-right direction. In this case, the slot opening 14 may have a slot length L along its longitudinal axis. As can be seen in FIG. 11, the one of the two legs 13*a* of the clip body 13 penetrates the slot opening 14. The protrusion portion 15 of the one of the two legs 13*a* extends in a direction parallel to the longitudinal axis of the slot opening 14 and has a length which is longer than the slot length L. With this configuration, the clip 11 can be movably mounted on the mounting structure 6 such that the clip 11 can be moved relative to the mounting structure in a front-rear direction. At the same time, the clip 11 can be prevented from moving out of the slot opening 14 of the mounting structure 6 which prevents losing the clips when the mounting structure is not fastened to the bottom wall.

Figure 8:
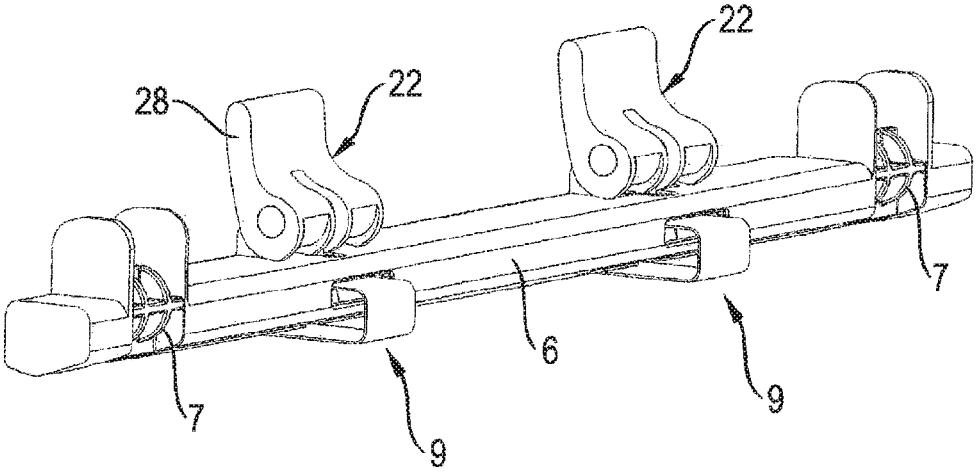
FIG. 8 is a perspective view of a mounting structure according to a second embodiment.

FIG. 8 is a perspective view of a mounting structure 6 according to a second embodiment. In the second embodiment of the mounting structure 6, as regards the overall shape of the mounting structure 6 and the second connection portions 7, the mounting structure 6 essentially has the same characteristics as the mounting structure 6 of the first embodiment. The second embodiment of the mounting structure 6 differs from the first embodiment thereof in the fastening member 9.

Figure 12:
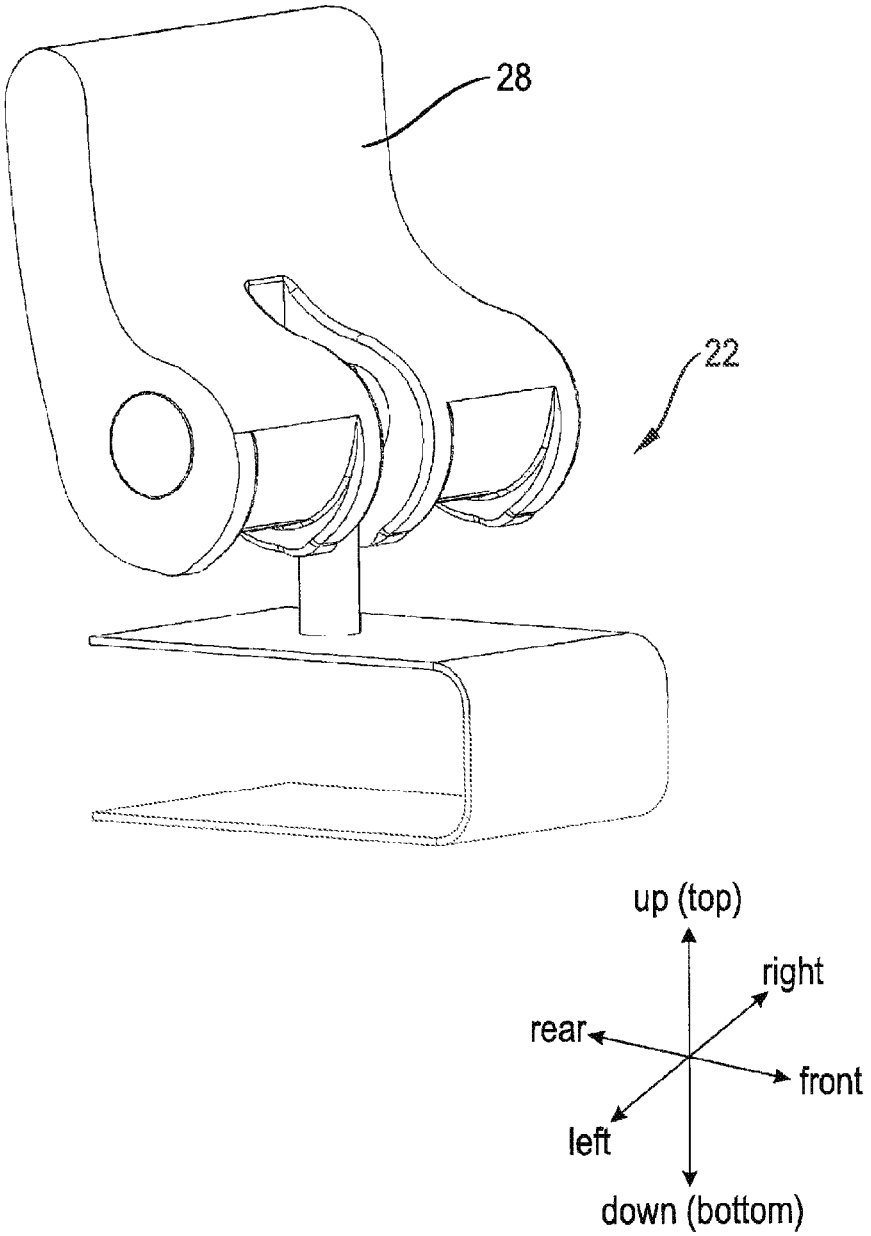
FIG. 12 is a perspective view of a clamp of the mounting structure of the second embodiment.
Figure 13:
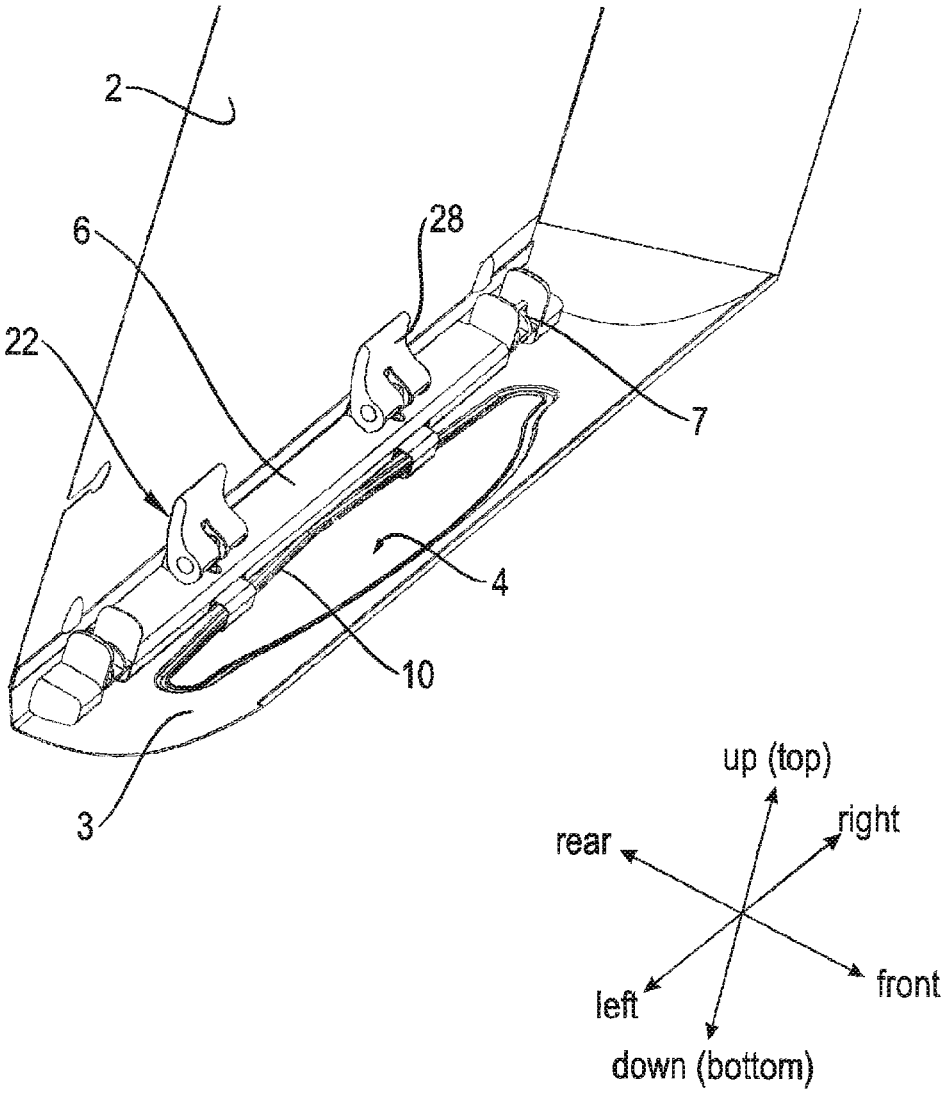
FIG. 13 is a perspective top view of the mounting structure of the second embodiment being fastened to the bottom wall of the recessed dispenser cabinet of FIG. 1.

In the second embodiment, the fastening member 9 is a clamp 22. An enlarged view of the clamp 22 is illustrated in FIG. 12. The clamp 22 comprises a lower U-shaped portion, the U-shaped portion comprising two legs. Similar to the first embodiment of the mounting structure 6, one of the two legs of the lower U-shaped portion penetrates the mounting structure 6, whereas the other of the two legs of the lower U-shaped portion encompasses the rear edge 10 of the dispensing opening 4 when the mounting structure 6 is fastened to the bottom wall 3 of the recessed cabinet 2, as can be seen in FIG. 13. The one of the two legs of the lower U-shaped portion of the clamp 22 is connected to a lever 28. The lever 28 is rotatably connected to the lower U-shaped portion of the clamp 22 in an eccentric-type manner. More specifically, when the lever 28 of the clamp 22 is rotated with respect to the lower U-shaped portion of the clamp 22, the clamp 22 changes from an unloaded state to a loaded state or vice versa. In FIG. 12, when the lever 28 points in an upper direction, the clamp 22 is in the loaded state and, when the lever 28 points in a front direction, the clamp 22 is in the unloaded state.

As can be seen in FIG. 13, when the mounting structure 6 according to the second embodiment is fastened to the bottom wall 3 of the recessed cabinet 2, the lever 28 of the clamp 22 points in an upper direction, that is the clamp 22 is in the loaded state, thereby pressing and fastening the mounting structure 6 against the bottom wall 3. The lever 28 may abut on the rear wall of the recessed cabinet 2 when the clamp 22 is in the loaded state.

Next, a method for mounting the dispensing mechanism 1 according to the embodiment within the recessed cabinet 2 will be described.

In the first step, the mounting structure 6 comprising the second connection portion 7 is placed on the bottom wall 3 of the recessed cabinet 2. In the second step, the mounting structure 6 is fastened to the bottom wall 3, for example, by means of the clips 11 or the clamps 22 described above or a combination thereof. In the third step, the first connection portion 5 provided at a lower portion of the dispensing mechanism 1 is attached to the second connection portion 7 of the mounting structure 6. If the first connection portion 5 is pivotably attachable to the second connection portion 7 and the dispensing mechanism 1 is attached to the mounting structure 6 while being positioned in a slanted position with respect to the recessed cabinet 2, in the fourth step, the dispensing mechanism 1 is pivoted into the dispenser cabinet 2. In the fifth step, the upper portion 8 of the dispensing mechanism 1 is attached to the dispenser cabinet 2.

Next, an embodiment of a dispenser 16 according to the disclosure for being mounted within an existing recessed cabinet 2 will be described.

Figure 14:
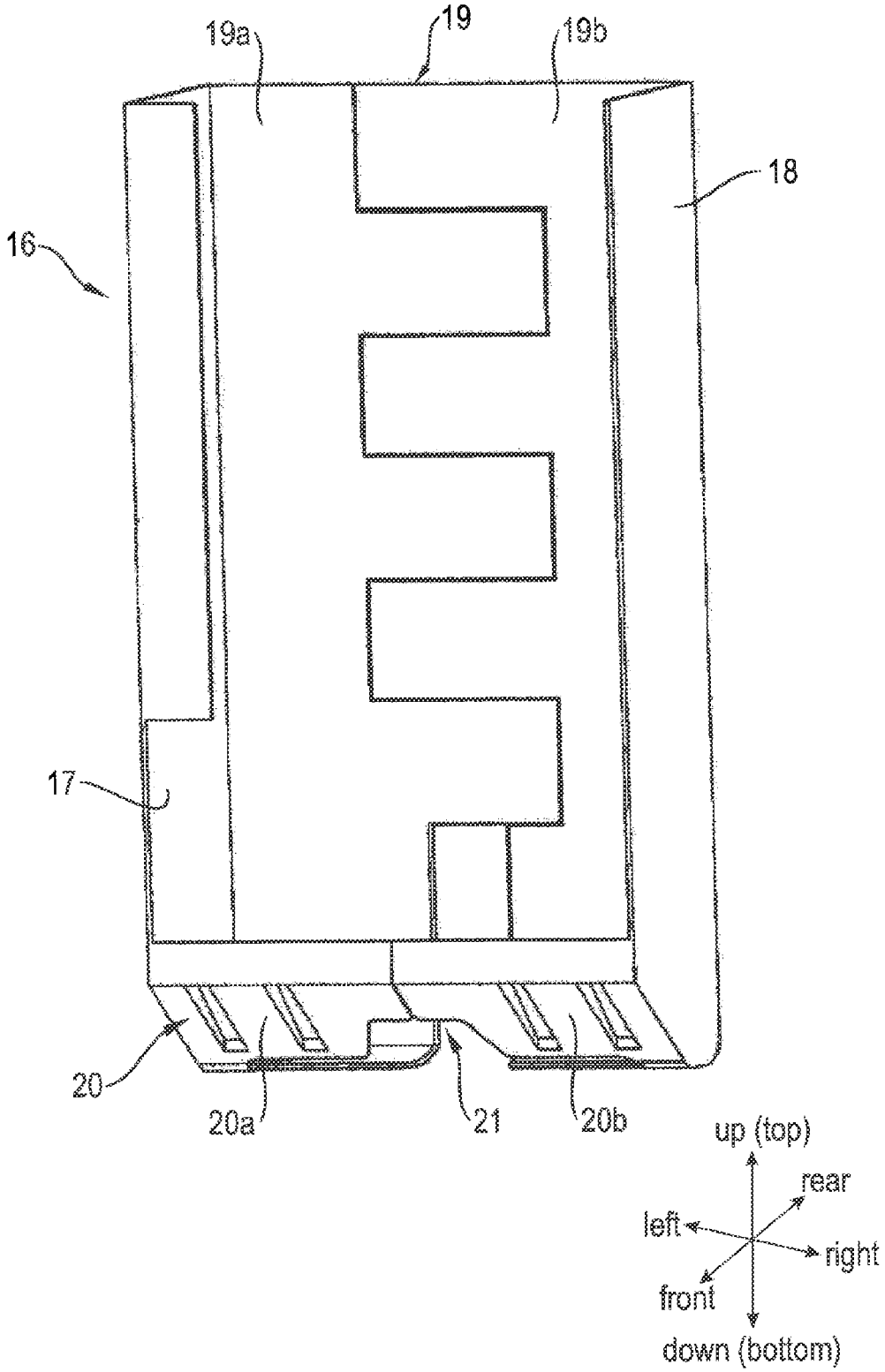
FIG. 14 is a perspective front view of a dispenser according to an embodiment.

FIG. 14 is a perspective front view of the dispenser 16 according to the embodiment. The dispenser 16 comprises a first side wall 17, a second side wall 18 opposing the first side wall 17, a rear wall 19 extending between the first side wall 17 and the second side wall 18, and a lower wall structure 20 being connected to lower ends of the first side wall 17, the second side wall 18, and the rear wall 19. The first side wall 17, the second side wall 18, the rear wall 19, and the lower wall structure 20 form a storage compartment for accommodating a stack of sheet products. Furthermore, the lower wall structure 20 defines a dispensing outlet 21 for dispensing the sheet products. As can be seen in FIG. 14, the rear wall 19 is composed of two rear wall parts 19*a*, 19*b* which are movably arranged relative to each other such that the space of the storage compartment can be adapted in the direction from the first side wall 17 to the second side wall 18, i.e. in a left-right direction of the recessed cabinet 2. In the same manner, the lower wall structure 20 is composed of two lower wall structure parts 20*a*, 20*b*. This configuration allows for an adaption of the dispenser 16 to the size of the sheet products.

Figure 15:
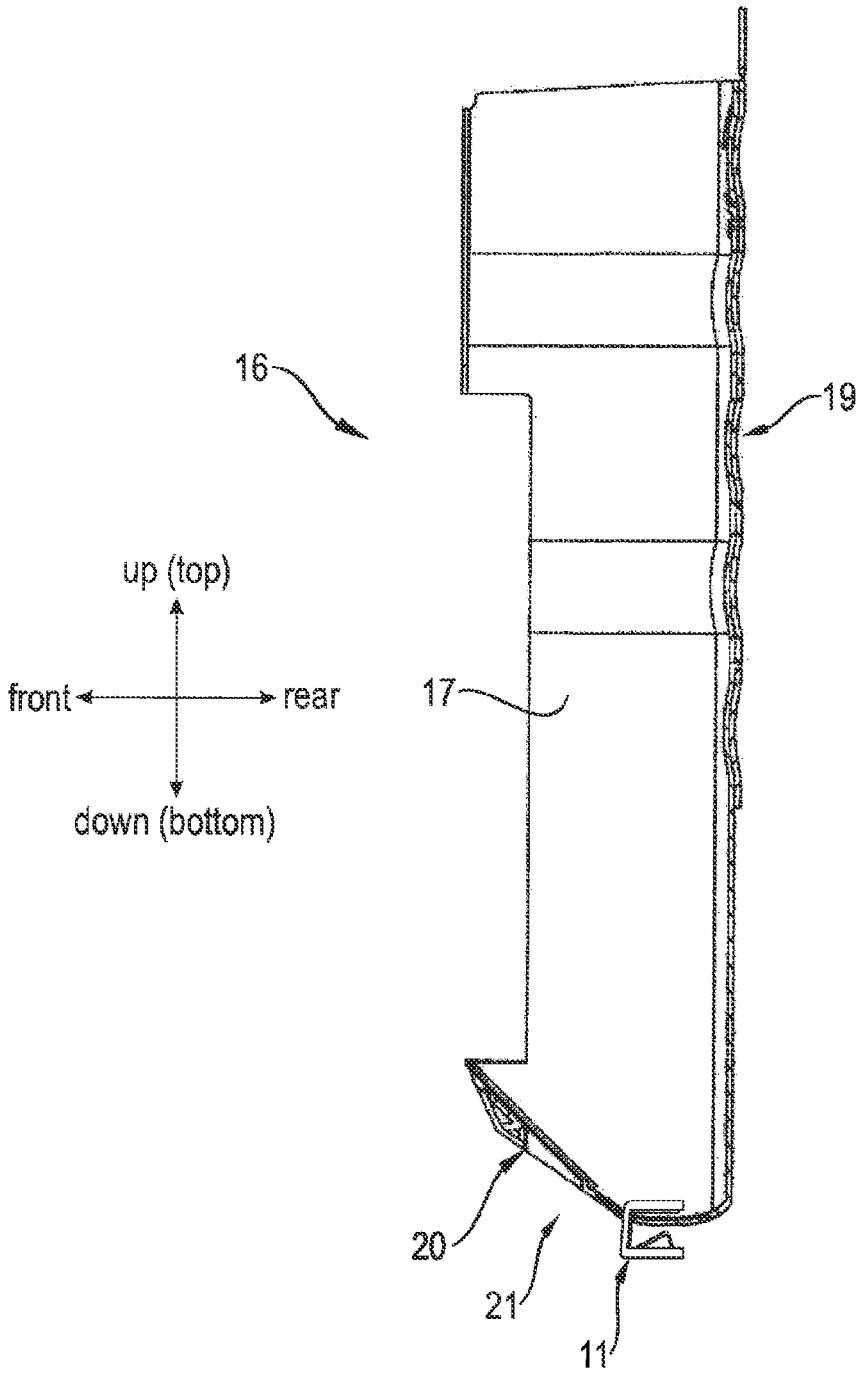
FIG. 15 is a cross-sectional side view of the dispenser of FIG. 14.

FIG. 15 is a cross-sectional side view of the dispenser 16 of FIG. 14. As can be seen, the lower wall structure 20 comprises a clip 11 as fastening member 9 for fastening the dispenser 16 to the rear edge 10 of the dispensing opening 4 of the recessed cabinet 2. The clip 11 is the same or has the same features as the clip 11 described above with respect to the first embodiment of the mounting structure 6. Furthermore, also the clamp 22 described above with respect to the second embodiment of the mounting structure 6 can be used as fastening member for fastening the dispenser 16 within the recessed cabinet 2.

LIST OF REFERENCE SIGNS

1 dispensing mechanism
2 existing dispenser cabinet
3 bottom wall
4 dispensing opening
5 first connection portion
6 mounting structure
7 second connection portion
8 upper portion (of the dispensing mechanism)
9 fastening member
10 rear edge (of the dispensing opening)
11 clip
12 spring clip
13 clip body
13*a*, 13*b* legs (of the clip)
14 slot opening
15 protrusion portion
16 dispenser
17 first side wall (of the dispenser)
18 second side wall (of the dispenser)
19 rear wall (of the dispenser)
19*a*, 19*b* rear wall parts (of the dispenser)
20 lower wall structure
20*a*, 20*b* lower wall structure parts
21 dispensing outlet
22 clamp

23 bin
24 magazine part
25 dispensing part
26 frame
27 bent portion (of the spring clip)
28 lever
29 first side wall (of the cabinet)
30 second side wall (of the cabinet)
31 rear wall (of the cabinet)
32 abutting portion (of the cabinet)
L slot length (of the slot opening)

The invention claimed is:

1. A set for mounting a dispensing mechanism for dispensing sheet products within an existing dispenser cabinet, wherein the existing dispenser cabinet comprises a bottom wall having a dispensing opening, wherein the dispensing mechanism comprises a lower portion, the lower portion comprising a first connection portion, the set comprising:

a mounting structure comprising a second connection portion to which the first connection portion of the lower portion is configured to be attached to support the dispensing mechanism, wherein the mounting structure is configured to be fastened to the bottom wall, wherein the mounting structure is separate from the dispensing mechanism;

wherein the dispensing opening of the bottom wall of the existing dispenser cabinet has an edge that is substantially horizontal and the mounting structure is configured to attach to the substantially horizontal edge of the dispensing opening.

2. The set according to claim 1, wherein the first connection portion is pivotably attachable to the second connection portion.

3. The set according to claim 2, wherein the second connection portion comprises a substantially cylindrical shape, wherein the first connection portion is substantially U-shaped and engageable with the second connection portion.

4. The set according to claim 1, wherein the dispensing mechanism further comprises an upper portion, wherein the upper portion is attachable to the dispenser cabinet.

5. The set according to claim 1, wherein the first connection portion is snappable onto or into the second connection portion.

6. The set according to claim 1, wherein the mounting structure comprises a fastening member fastenable to an edge of the dispensing opening.

7. The set according to claim 6, wherein the dispensing opening includes a rear edge, and the fastening member is fastenable to the rear edge of the dispensing opening.

8. The set according to claim 6, wherein the fastening member of the mounting structure is configured to be fastened to the bottom wall without structurally modifying the bottom wall.

9. The set according to claim 6, wherein the fastening member is selected from the group consisting of a clip, a clamp, a tape, a hook and loop fastener, and combinations thereof.

10. The set according to claim 9, wherein the fastening member is a clip, wherein the clip comprises a spring clip having a substantially U-shaped cross section.

11. The set according to claim 10, wherein the clip further comprises a clip body having a substantially U-shaped cross section and encasing the spring clip.

12. The set according to claim 11, wherein the mounting structure comprises one or more than one slot opening, the slot opening having a slot length along its longitudinal axis, wherein the clip body comprises two legs, wherein one of the two legs penetrates the slot opening, the one of the two legs comprising a protrusion portion extending in a direction parallel to the longitudinal axis of the slot opening and having a length longer than the slot length.

13. The set according to claim 1, wherein the mounting structure is substantially bar-shaped.

14. The set according to claim 13, wherein the mounting structure is adjustable in length in its longitudinal direction.

15. The set according to claim 1, wherein the set is configured for mounting the dispensing mechanism within a recessed cabinet as the existing dispenser cabinet.

16. A method for mounting a dispensing mechanism for dispensing sheet products within an existing dispenser cabinet that comprises a bottom wall having a dispensing opening using set of claim 1, the method comprises the steps of:

i) placing the mounting structure comprising the second connection portion on the bottom wall, ii) fastening the mounting structure to the bottom wall, iii) mounting the dispensing mechanism by at least attaching the first connection portion provided at the lower portion of the dispensing mechanism to the second connection portion of the mounting structure;

wherein the dispensing opening of the bottom wall of the existing dispenser cabinet has an edge that is substantially horizontal and the mounting structure is configured to attach to the substantially horizontal edge of the dispensing opening.

17. The method according to claim 16, wherein the first connection portion is pivotably attachable to the second connection portion, wherein the method subsequent the step iii) further comprises the step of:

iv) pivoting the dispensing mechanism into the dispenser cabinet.

18. The method according to claim 17, wherein the method subsequent the step iv) further comprises the step of:

v) attaching an upper portion of the dispensing mechanism to the dispenser cabinet.

19. The method according to claim 16, wherein the dispensing mechanism is mounted within a recessed cabinet as the existing dispenser cabinet.

20. A dispenser for being mounted within an existing dispenser cabinet, wherein the existing dispenser cabinet comprises a bottom wall having a dispensing opening, wherein the dispensing mechanism comprises a lower portion, the lower portion comprising a first connection portion, the dispenser comprising:

a first side wall, a second side wall opposing the first side wall, a rear wall extending between the first side wall and the second side wall, a lower wall structure being connected to lower ends of the first side wall, the second side wall, and the rear wall, wherein the first side wall, the second side wall, the rear wall, and the lower wall structure form a storage compartment for accommodating a stack of sheet products, the lower wall structure defining a dispensing outlet for dispensing the sheet products, wherein the lower wall structure is configured to be fastened to the bottom wall of the existing dispenser cabinet through a connection between a first connection portion on the lower wall structure and a mounting structure fastened to the bottom wall of the existing dispenser cabinet;

wherein the mounting structure comprises a fastening member fastenable to an edge of the dispensing opening.

21. The dispenser according to claim 20, wherein the rear wall is attachable to the dispenser cabinet.

22. The dispenser according to claim 20, wherein the fastening member is fastenable to a rear edge of the dispensing opening.

23. The dispenser according to claim 20, wherein the fastening member of the mounting structure is configured to be fastened to the bottom wall without structurally modifying the bottom wall.

24. The dispenser according to claim 20, wherein the fastening member is selected from the group consisting of a clip, a clamp, a tape, a hook and loop fastener, and combinations thereof.

25. The dispenser according to claim 24, wherein the fastening member is a clip, wherein the clip comprises a spring clip having a substantially U-shaped cross section.

26. The dispenser according to claim 25, wherein the clip further comprises a clip body having a substantially U-shaped cross section and encasing the spring clip.

27. The dispenser according to claim 26, wherein the mounting structure comprises one or more than one slot opening, the slot opening having a slot length along its longitudinal axis, wherein the clip body comprises two legs, wherein one of the two legs penetrates the slot opening, the one of the two legs comprising a protrusion portion extending in a direction parallel to the longitudinal axis of the slot opening and having a length longer than the slot length.

28. The dispenser according to claim 20, wherein the dispenser is configured for being mounted within a recessed cabinet as the existing dispenser cabinet.

29. A set for mounting a dispensing mechanism for dispensing sheet products within an existing dispenser cabinet, wherein the existing dispenser cabinet comprises a bottom wall having a dispensing opening, wherein the dispensing mechanism comprises a lower portion, the lower portion comprising a first connection portion, the set comprising:

a mounting structure comprising a second connection portion to which the first connection portion of the lower portion is configured to be attached to support the dispensing mechanism, wherein the mounting structure is configured to be fastened to the bottom wall of the dispenser cabinet, wherein the mounting structure is separate from the dispensing mechanism;

at least one clip;

the at least one clip includes two legs, the two legs being arranged such that a portion of the mounting structure and an edge of the dispensing opening in the bottom wall can be secured between the two legs so as to fasten the mounting structure to the edge of the dispensing opening in the bottom wall.

30. The set according to claim 29, wherein the clip is a spring clip.

31. A dispenser for being mounted within an existing dispenser cabinet, wherein the existing dispenser cabinet comprises a bottom wall having a dispensing opening, wherein the dispensing mechanism comprises a lower portion, the lower portion comprising a first connection portion, the dispenser comprising:

a first side wall, a second side wall opposing the first side wall, a rear wall extending between the first side wall and the second side wall, a lower wall structure being connected to lower ends of the first side wall, the second side wall, and the rear wall, wherein the first side wall, the second side wall, the rear wall, and the lower wall structure form a storage compartment for accommodating a stack of sheet products, the lower wall structure defining a dispensing outlet for dispensing the sheet products, wherein the lower wall structure is configured to be fastened to the bottom wall of the existing dispenser cabinet through a connection between a first connection portion on the lower wall structure and a mounting structure fastened to the bottom wall of the existing dispenser cabinet;

wherein the dispensing opening of the bottom wall of the existing dispenser cabinet has an edge that is substantially horizontal and the mounting structure is configured to attach to the substantially horizontal edge of the dispensing opening.

* * * * *